US008250816B2

(12) United States Patent
Donnally et al.

(10) Patent No.: US 8,250,816 B2
(45) Date of Patent: Aug. 28, 2012

(54) DRILLING RIG STRUCTURE INSTALLATION AND METHODS

(75) Inventors: Robert Benjamin Donnally, Shanghai (CN); Chunqiao Ren, Shanghai (CN); Stuart Arthur Lyall McCurdy, Alberta (CA); Xi Lin Liui, Duyan (CN); Hui Chun Sheng, Shanghai (CN); Yan Yu, Shanghai (CN); He Hui Chen, Shanghai (CN)

(73) Assignee: National Oilwell Varco L.P., Houston, TX (US)

( * ) Notice: Subject to any disclaimer, the term of this patent is extended or adjusted under 35 U.S.C. 154(b) by 1217 days.

(21) Appl. No.: 12/074,264

(22) Filed: Feb. 29, 2008

(65) Prior Publication Data

US 2009/0218138 A1 Sep. 3, 2009

(51) Int. Cl.
*B66C 23/26* (2006.01)
*B66C 23/60* (2006.01)
*B66C 23/30* (2006.01)

(52) U.S. Cl. ..... 52/123.1; 52/117; 52/119; 52/745.17; 52/745.18

(58) Field of Classification Search ..... 52/123.1, 52/111, 117, 118, 120, 40, 119, 745.17, 745.18; 173/1, 28, 24, 85, 184
See application file for complete search history.

(56) References Cited

U.S. PATENT DOCUMENTS 2,268,796 A 1/1942 Brauer ..... 189/15
2,701,039 A * 2/1955 Woolslayer et al. ..... 52/292
2,703,634 A * 3/1955 Lee ..... 52/115
2,857,993 A 10/1958 Terrell ..... 189/11
2,993,570 A 7/1961 Bender ..... 52/118
3,033,527 A * 5/1962 Wilson ..... 254/323
3,109,523 A * 11/1963 Moller ..... 52/115
3,201,091 A 8/1965 Woolslayer et al. ..... 51/120 X
3,228,151 A 1/1966 Woolslayer et al. ..... 52/64
3,262,237 A 7/1966 Jenkins et al. ..... 52/116
3,333,377 A * 8/1967 Woolslayer et al. ..... 52/116

(Continued)

FOREIGN PATENT DOCUMENTS

GB 2 046 332 A 11/1980

OTHER PUBLICATIONS

Mobile Rigs, National Oilwell. 8 pp.. 2005.

(Continued)

*Primary Examiner* — Phi D. A
(74) *Attorney, Agent, or Firm* — Williams, Morgan & Amerson, P.C.

(57) ABSTRACT

A method for installing rig structure (e.g. cabin, house, a doghouse) on a drilling rig, the method including: connecting support apparatus to a substructure of a drilling rig, supporting a drilling floor; moving a movement apparatus supporting a rig structure to position it adjacent the support apparatus, by moving movement apparatus on ground adjacent the substructure, moving the support apparatus into a connecting orientation with respect to the structure; connecting raising apparatus to the structure, the raising apparatus connected to the support apparatus; raising the structure up to the drill floor with the raising apparatus; and securing the structure to the support apparatus. This abstract is provided to comply with the rules requiring an abstract which will allow a searcher or other reader to quickly ascertain the subject matter of the technical disclosure and is submitted with the understanding that it will not be used to interpret or limit the scope or meaning of the claims, 37 C.F.R. 1.72(b).

22 Claims, 19 Drawing Sheets

U.S. PATENT DOCUMENTS

| | | | | | |
|---|---|---|---|---|---|
| 3,340,938 | A | | 9/1967 | Wilson | 173/28 |
| 3,749,183 | A | | 7/1973 | Branham et al. | 173/151 |
| 3,807,109 | A | | 4/1974 | Jenkins et al. | 52/120 |
| 3,922,825 | A | | 12/1975 | Eddy et al. | 52/116 |
| 3,942,593 | A | * | 3/1976 | Reeve, Jr. et al. | 173/186 |
| 3,981,485 | A | | 9/1976 | Eddy et al. | 254/186 R |
| 3,987,594 | A | * | 10/1976 | Rao et al. | 52/111 |
| 4,021,978 | A | * | 5/1977 | Busse et al. | 52/118 |
| 4,024,924 | A | | 5/1977 | Houck | 173/151 |
| 4,103,503 | A | | 8/1978 | Smith | 61/97 |
| 4,138,805 | A | | 2/1979 | Patterson | 52/118 |
| 4,221,088 | A | | 9/1980 | Patterson | 52/116 |
| 4,267,675 | A | * | 5/1981 | Cochran | 52/118 |
| 4,269,009 | A | | 5/1981 | Lawrence | 52/116 |
| 4,269,395 | A | | 5/1981 | Newman et al. | 254/386 |
| 4,290,495 | A | | 9/1981 | Elliston | 175/85 |
| 4,292,772 | A | | 10/1981 | Borg et al. | 52/118 |
| 4,305,237 | A | | 12/1981 | Borg et al. | 52/116 |
| 4,366,650 | A | * | 1/1983 | Patterson | 52/118 |
| 4,368,602 | A | * | 1/1983 | Manten | 52/115 |
| 4,371,046 | A | | 2/1983 | Read | 175/57 |
| 4,375,892 | A | | 3/1983 | Jenkins et al. | 280/43.23 |
| 4,438,904 | A | | 3/1984 | White | 254/311 |
| 4,478,015 | A | | 10/1984 | Lawrence et al. | 52/120 |
| 4,489,526 | A | | 12/1984 | Cummins | 52/125.6 |
| 4,569,168 | A | | 2/1986 | McGovney et al. | 52/122.1 |
| 4,587,778 | A | | 5/1986 | Woolslayer et al. | 52/116 |
| 4,591,006 | A | | 5/1986 | Hutchison | 175/52 |
| 4,630,425 | A | | 12/1986 | Reed | 52/45.18 |
| 4,684,314 | A | | 8/1987 | Luth | 414/745 |
| 4,757,592 | A | | 7/1988 | Reed | 29/429 |
| 4,821,816 | A | | 4/1989 | Willis | 175/57 |
| 4,831,795 | A | | 5/1989 | Sorokan | 52/120 |
| 4,837,992 | A | | 6/1989 | Hashimoto | 52/118 |
| 4,899,832 | A | | 2/1990 | Bierscheid, Jr. | 173/23 |
| 4,932,175 | A | * | 6/1990 | Donnally | 52/118 |
| 5,109,934 | A | | 5/1992 | Mochizuki | 175/170 |
| 5,251,709 | A | | 10/1993 | Richardson | 175/1 |
| 5,342,020 | A | | 8/1994 | Stone | 254/269 |
| 5,425,435 | A | | 6/1995 | Gregory | 188/77 W |
| 6,029,951 | A | | 2/2000 | Guggari | 254/269 |
| 6,182,945 | B1 | | 2/2001 | Dyer et al. | 254/340 |
| 6,474,926 | B2 | | 11/2002 | Weiss | 414/332 |
| 6,523,319 | B2 | | 2/2003 | Bockhorn et al. | 52/651.01 |
| 6,634,436 | B1 | | 10/2003 | Desai | 173/1 |
| 6,848,515 | B2 | | 2/2005 | Orr et al. | 173/1 |
| 6,860,337 | B1 | | 3/2005 | Orr et al. | 173/28 |
| 6,944,547 | B2 | | 9/2005 | Womer et al. | 702/7 |
| 6,962,030 | B2 | | 11/2005 | Conn | 52/741.1 |
| 6,994,171 | B2 | | 2/2006 | Orr et al. | 173/28 |
| 7,155,873 | B2 | | 1/2007 | Palidis | 52/702 |
| 7,210,670 | B2 | | 5/2007 | Franks | 254/294 |
| 7,306,055 | B2 | | 12/2007 | Barnes | 175/57 |
| 7,308,953 | B2 | | 12/2007 | Barnes | 175/203 |
| 7,357,616 | B2 | | 4/2008 | Andrews et al. | 414/332 |
| 7,377,335 | B2 | | 5/2008 | Jones et al. | 175/57 |
| 2005/0236790 | A1 | | 10/2005 | Carter | 280/79.11 |
| 2006/0213653 | A1 | | 9/2006 | Cunningham et al. | 166/77.1 |

OTHER PUBLICATIONS

Ideal Rig System. National Oilwell. 8 pp. 2004.
PCT/GB2009/050070 International Search Report (Nov. 25, 2010).
U.S. Appl. No. 12/069,913, filed Feb 13, 2008, Chehade et al.
U.S. Appl. No. 12/074,258, filed Feb 29, 2008, Donnally et al.
U.S. Appl. No. 12/074,232, filed Feb 29, 2008, Donnally et al.
U.S. Appl. No. 12/074,270, filed Feb 29, 2008, Donnally et al.

* cited by examiner

FIG. 5C
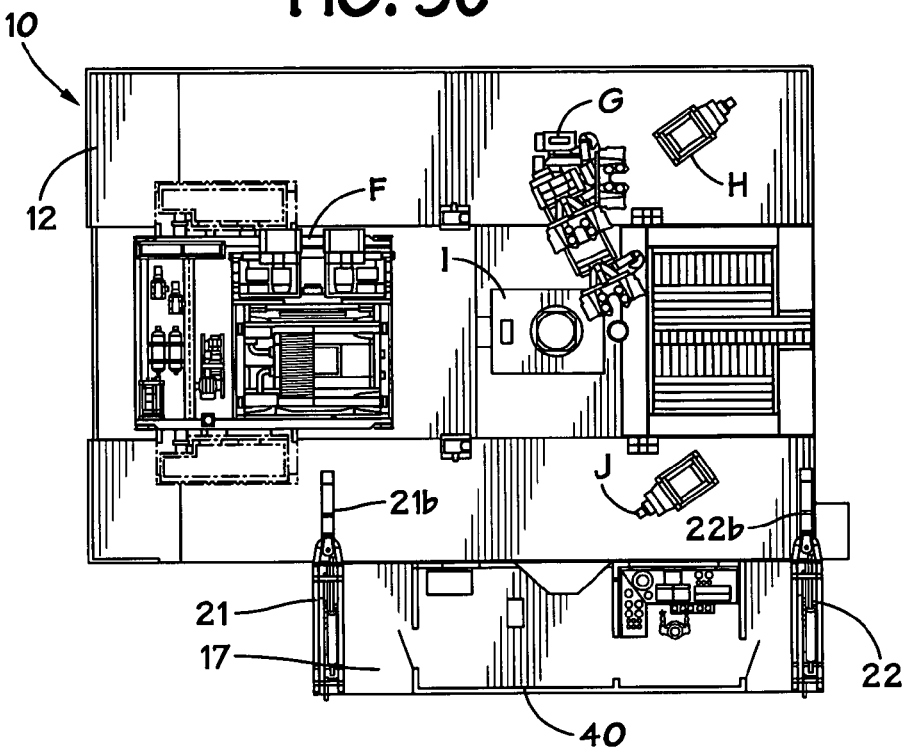
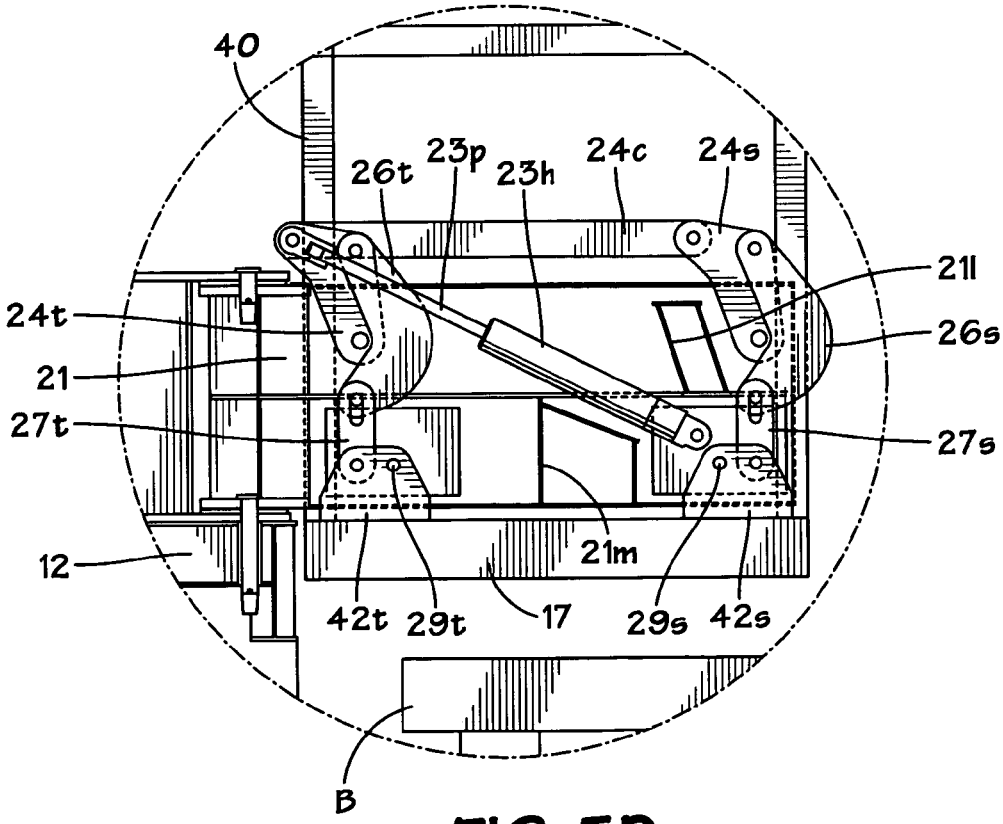
FIG. 5D

FIG. 7A
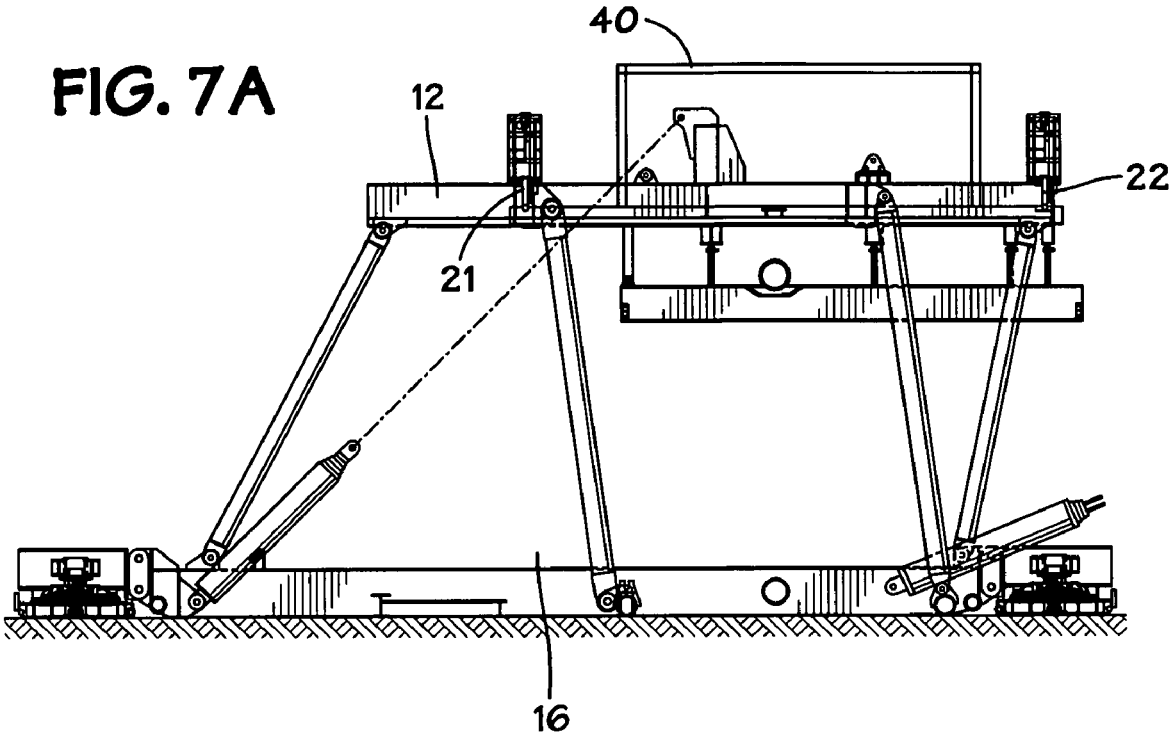
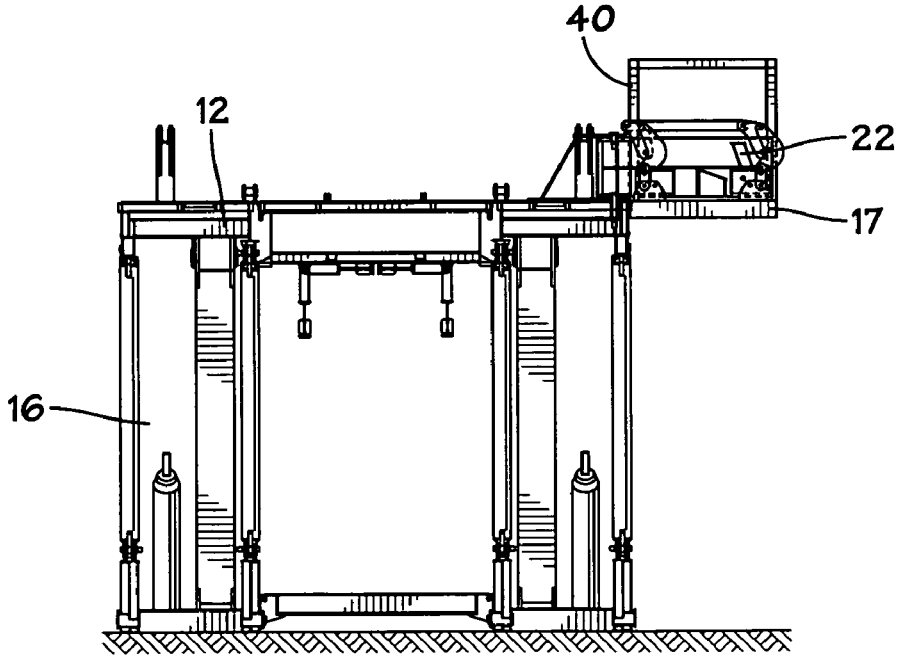
FIG. 7B

FIG. 13A
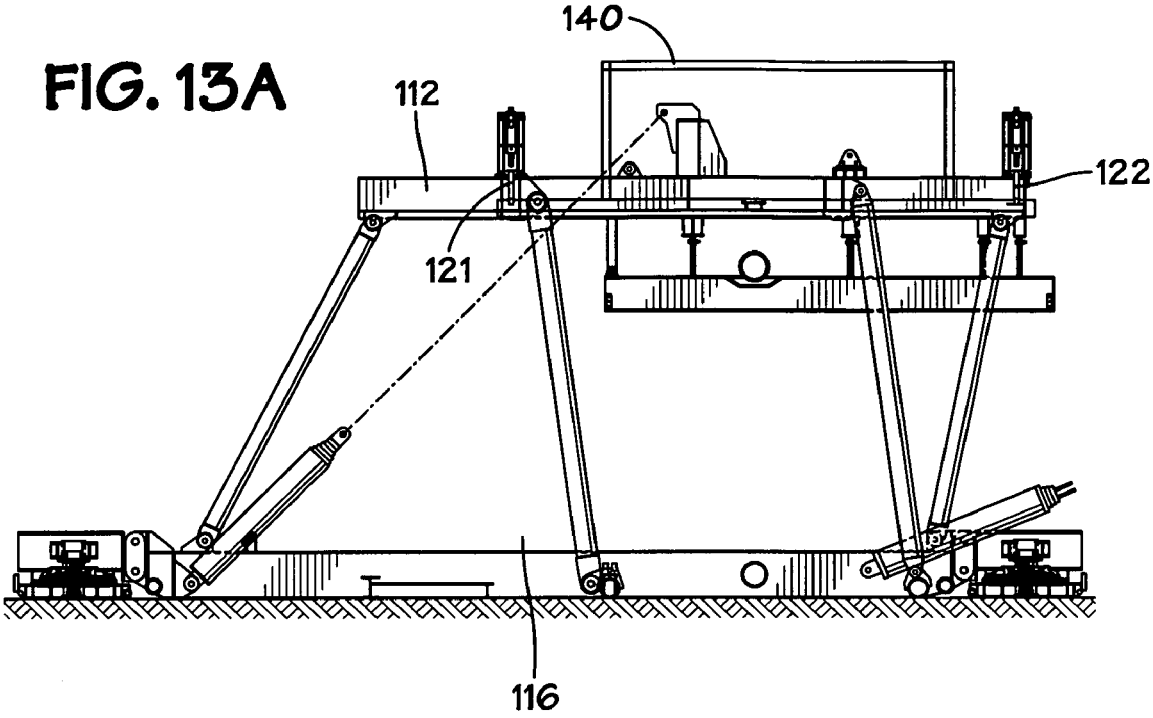
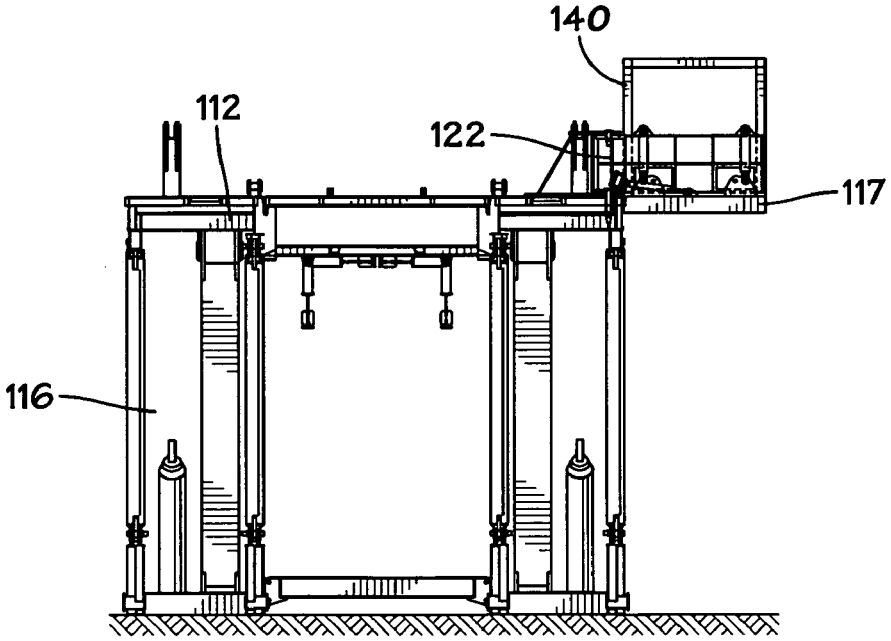
FIG. 13B

DRILLING RIG STRUCTURE INSTALLATION AND METHODS

BACKGROUND OF THE INVENTION

1. Field of the Invention

This invention is directed to drilling rigs; drilling rigs with structure thereon such as a doghouse, driller's cabin, building, or electrical control house; and to methods for installing such structures on a rig.

2. Description of Related Art

The prior art discloses a variety of rigs used in drilling and various wellbore operations; for example, and not by way of limitation, U.S. Pat. Nos. 3,340,938; 3,807,109; 3,922,825; 3,942,593; 4,269,395; 4,290,495; 4,368,602; 4,489,526; 4,569,168; 4,837,992; 6,634,436; 6,523,319 and 7,306,055 and the references cited in these patents—all these patents incorporated fully herein for all purposes. The prior art discloses a variety of systems and methods for assembling and raising components of a drilling rig; for example, and not by way of limitation nor as an exhaustive listing, the disclosures in U.S. Pat. Nos. 2,993,570; 3,201,091; 3,262,237; 3,749,183; 4,221,088; 4,269,009; 4,292,772; 4,305,237; 4,478,015; 4,587,778; 4,630,425; and 4,932,175.

Often drilling rigs and related systems, structures, equipment, and apparatuses are delivered to a site, assembled, raised, disassembled, and transported to a new site. It is important that drilling rigs and their components be easily transported and assembled.

Many components and structures used with a rig are raised by a crane and positioned on a rig's drill floor. Various problems and disadvantages are associated with installing structure, e.g. a doghouse, on a rig using a crane. A crane is typically a large apparatus which is transported to a drilling site where it is assembled and/or made ready for lifting and locating rig components.

BRIEF SUMMARY OF THE INVENTION

The present invention, in certain aspects, provides a drilling rig with structure manipulation and raising apparatus and methods for using such apparatus to raise and install a structure on a drilling rig without using a crane, without winching up cables, and without lifting with a drawworks system.

In certain aspects, the present invention discloses a system including lifting apparatus on a rig for engaging a structure (building, house, cabin, doghouse) on a trailer (or other similar support), lifting the structure from the trailer, and moving the structure onto the drill floor. In this method the structure is installed without using a crane, cables, or a drawworks.

The present invention discloses, in certain aspects, methods for installing a rig structure on a drilling rig, the methods including: positioning a rig structure on a movement apparatus adjacent a rig support apparatus; moving the support apparatus into a connecting orientation with respect to the rig structure, the support apparatus having raising apparatus connected thereto; connecting the raising apparatus to the rig structure; and raising the rig structure with the raising apparatus. In certain aspects, the rig structure is a house, doghouse, cabin, driller cabin, and electrical control house.

The present invention discloses, in certain aspects, handling systems for securing a rig structure to a drilling rig, the handling systems including: movement apparatus for initially supporting a rig structure and for moving on ground adjacent a drilling rig to position the rig structure with respect to the drilling rig, the drilling rig having a substructure with a drill floor; support apparatus movably connected to the drill floor for selectively supporting the rig structure, the support apparatus movable out of the way to facilitate positioning of the rig structure with respect to the drill floor and the support apparatus movable adjacent the rig structure for connection thereto; and raising apparatus connected to the support apparatus, the raising apparatus for selectively raising the rig structure with respect to the drill floor. In certain aspects, the rig structure is a house, doghouse, cabin, driller cabin, and electrical control house.

The present invention, in certain aspects, discloses a method for installing a rig structure on a drilling rig, the method including: positioning a rig structure on a movement apparatus (e.g. a trailer pulled by a truck) adjacent a support apparatus, the support apparatus connected to a substructure of a drilling rig, the support apparatus movably connected to the substructure, the substructure supporting a drilling floor, this positioning effected by moving the movement apparatus on ground adjacent the substructure; moving the support apparatus into a connecting orientation with respect to the rig structure, the support apparatus having raising apparatus connected thereto; connecting the raising apparatus to the rig structure; and raising the rig structure with the raising apparatus.

The present invention discloses, in certain aspects, a handling system for installing a rig structure on a drilling rig, the handling system including movement apparatus for initially supporting a rig structure and for moving on ground adjacent a drilling rig to position the rig structure with respect to the drilling rig, the drilling rig having a substructure with a drill floor; support apparatus movably connected to the drill floor for selectively supporting the rig structure, the support apparatus movable out of the way to facilitate positioning of the rig structure with respect to the drill floor and the support apparatus movable adjacent the rig structure for connection thereto; and raising apparatus connected to the support apparatus, the raising apparatus for selectively raising the rig structure with respect to the drill floor.

Accordingly, the present invention includes features and advantages which are believed to enable it to advance drilling rig technology and rig structure installation technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide the embodiments and aspects listed above and:

New, useful, unique, efficient, non-obvious drilling rigs; rig structure installation methods; and new, useful, unique, efficient, nonobvious rig structure installation apparatus and methods; and Such systems with rig structure lifting apparatus for raising a structure (e.g., but not limited to, a doghouse or cabin) and moving the structure level with a drill floor; and Such systems and methods in which a rig structure is moved, raised, and secured to a rig without using a crane without winching up cables, and without using a drawworks to lift the structure.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later attempt to disguise it by variations in form or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

FIG. 5C is a top view of the step of FIG. 5A.

FIG. 5D is an enlarged view of part of the rig shown in the step of FIG. 5A.

FIG. 7A is a side view illustrating a rig raised in the method according to the present invention with a doghouse installed on the rig.

FIG. 7B is an end view of the rig of FIG. 7A.

FIG. 13A is a side view illustrating a rig raised in a method according to the present invention with a doghouse installed on the rig.

FIG. 13B is an end view of the rig of FIG. 13A.

Figure 1A:
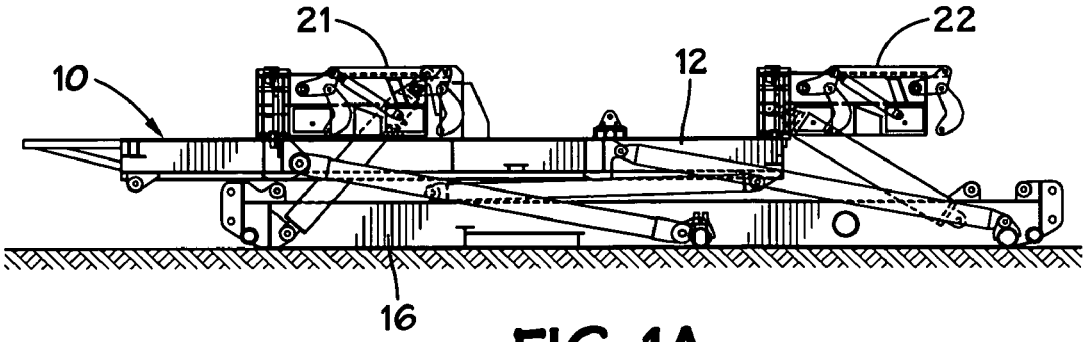
FIG. 1A is a side view of part of a drilling rig according to the present invention.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference. So long as they are not mutually exclusive or contradictory any aspect or feature or combination of aspects or features of any embodiment disclosed herein may be used in any other embodiment disclosed herein.

DETAILED DESCRIPTION OF THE INVENTION

Figure 1B:
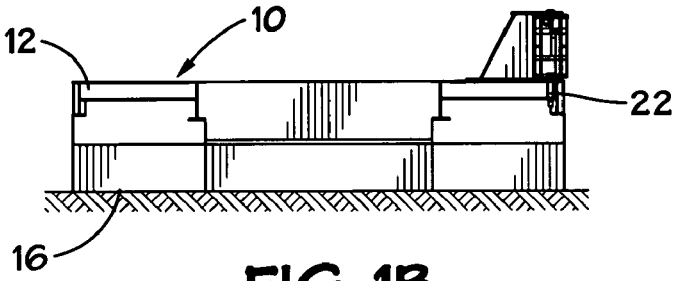
FIG. 1B is an end view of the rig FIG. 1A.
Figure 1C:
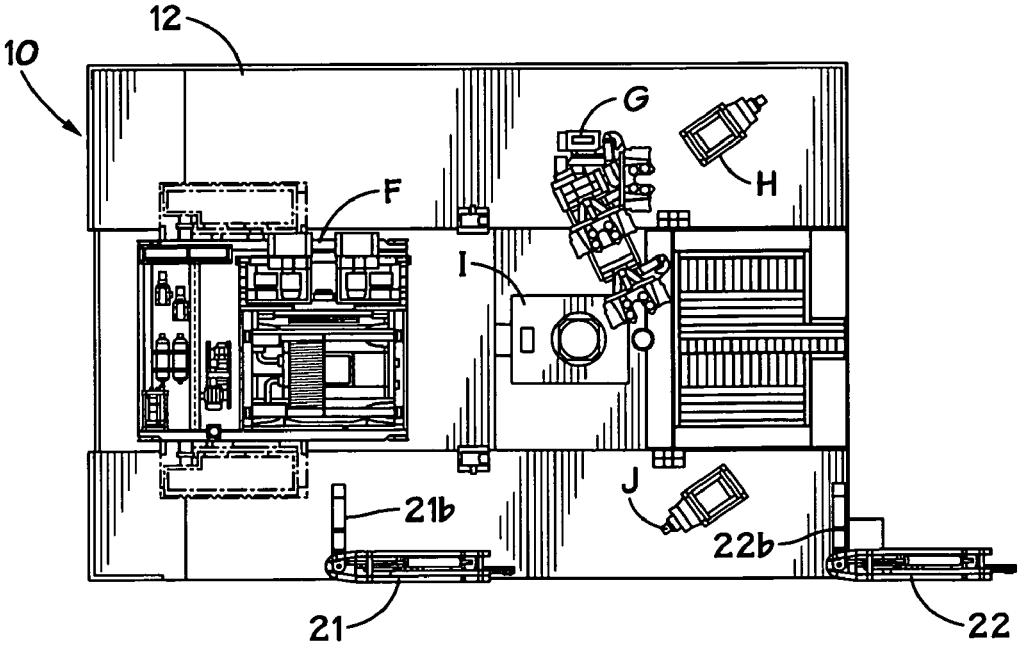
FIG. 1C is a top view of the rig of FIG. 1A.
Figure 1D:
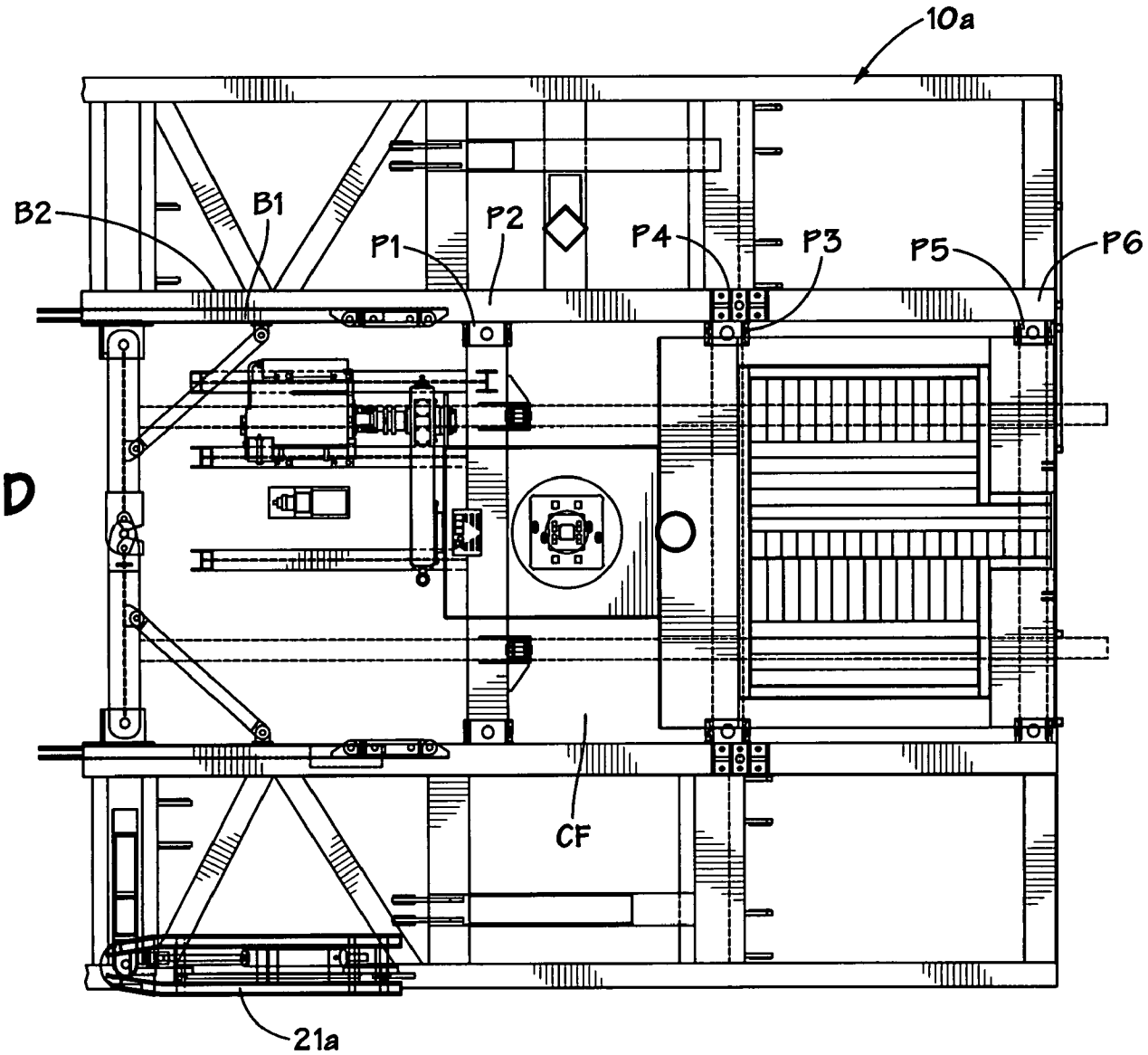
FIG. 1D is a top view of part of a rig like the rig of FIGS. 1A-2A.

FIGS. 1A, 1B and 1C show a rig 10 with rig equipment F, G, H, I, J on a drill floor 12, the drill floor 12 is raised by a substructure 16 to which the drill floor 12 is connected. Connected to the substructure 16 is a structure lifting and movement apparatus which includes a left suspending arm 21 and a right suspending arm 22.

Each suspending arm 21, 22 (see FIGS. 2A, 2B) has support beams (see beams 21*l*, 21*m*, FIG. 2B) and is pivotably connected with pins (e.g. see pins 21*c*, 21*d* for the arm 21) to a base 21*b*, 22*b*, respectively, and these bases are secured or formed integrally of the drill floor 12. The suspending arms 21, 22 can pivot 180° on their bases. Each suspending arm has a linkage assembly raised and lowered by an hydraulic cylinder apparatus 23 (one arm at each end of the skid 17 of the structure 40). A piston 23*p* of each apparatus 23 movable in a housing 23*h* is connected to a first top link 24*t*. A pin 23*z* connects a lower end of the housing 23*h* to the arm 21. A crosslink 24*c* is interconnected between the first top link 24*t* and a second top link 24*s* so that when the first top link 24*t* is moved up by extending the movable piston 23*p* of the apparatus 23, the second top link 24*s* is also moved up. An end of each top link is pinned with a pin 25 to the suspension arm (21 or 22) so that the upper ends of the first top link 24*t* and of the second top link 24*s* are free to pivot up when raised by the movable piston 23*p*.

Two intermediate links are connected to the top links; e.g. a top of a first intermediate link 26*t* is pivotably connected to the top link 24*t* and the top of a second intermediate link 26*s* is pivotably connected to the second top link 24*s*. When the top links are raised, the intermediate links are raised with them.

FIGS. 1D-1L illustrate structure for connection of various parts of a rig 10*a* like the rig 10; shown with a drawworks deleted (like the equipment F, FIG. 1C). The rig 10*a* has two arms like the arms 21, 22, FIG. 1C; but only one arms 21*a* is shown.

FIGS. 1E-1L illustrate various connection structures both before a center floor CF is installed and after a center floor CF is installed. The views of FIGS. 1E-1L are along the lines of FIG. 1D as indicated above.

Figure 1E:
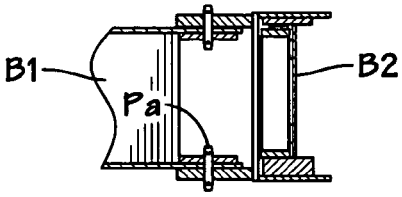
FIG. 1E is a side view showing a connection of parts of the rig of FIG. 1D after installation and FIG. 1E is a view along line A-A of FIG. 1D.
Figure 1F:
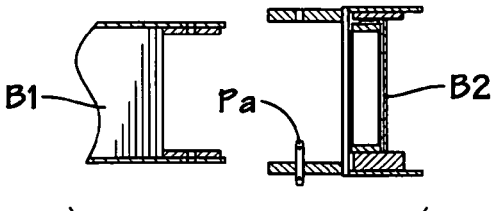
FIG. 1F is a side view showing a connection of parts of the rig of FIG. 1D before installation.

FIGS. 1E and 1F illustrate the connection of beams B1 and B2 with pins Pa.

Figure 1G:
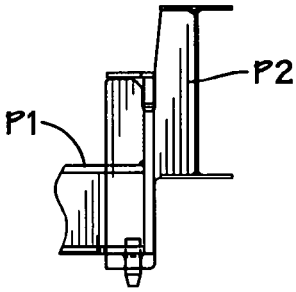
FIG. 1G is a side view showing a connection of parts of the rig of FIG. 1D after installation and FIG. 1G is a view along line B-B of FIG. 1D.
Figure 1H:
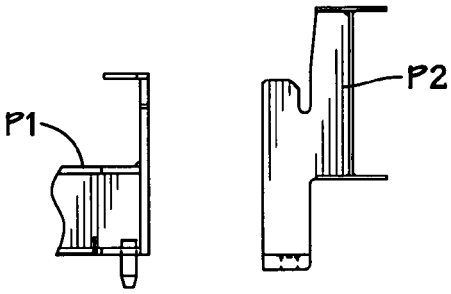
FIG. 1H is a side view showing a connection of parts of the rig of FIG. 1D before installation.

FIGS. 1G and 1H illustrate the connection of parts P1 and P2.

Figure 1I:
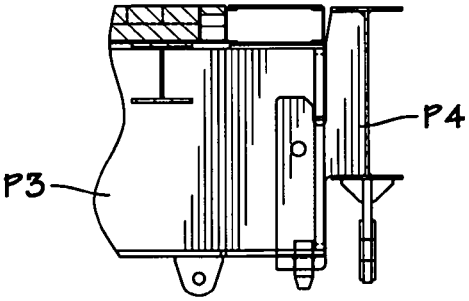
FIG. 1I is a side view showing a connection of parts of the rig of FIG. 1D after installation and FIG. 1I is a view along line C-C of FIG. 1D.
Figure 1J:
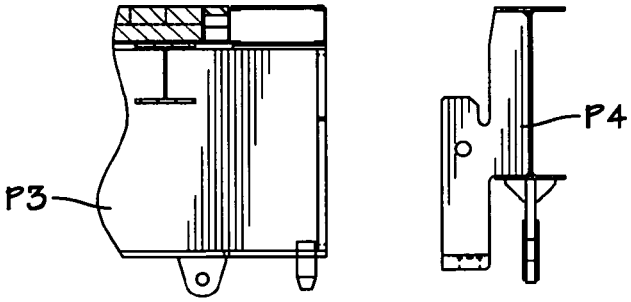
FIG. 1J is a side view showing a connection of parts of the rig of FIG. 1D before installation.
Figure 1K:
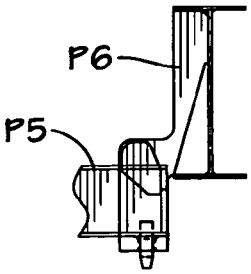
FIG. 1K is a side view showing a connection of parts of the rig of FIG. 1D after installation and FIG. 1K is a view along line D-D of FIG. 1D.
Figure 1L:
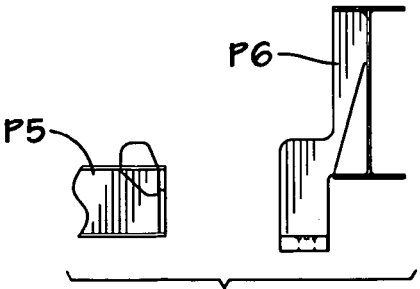
FIG. 1L is a side view showing a connection of parts of the rig of FIG. 1D before installation.

FIGS. 1I and 1L illustrate the connection of parts P3 and P4.

FIGS. 1K and 1L illustrate the connection of parts P5 and P6.

Two lower links releasably and pivotably connect each intermediate link to lugs on a skid 17 supporting a structure 40, e.g. a doghouse (supported on a trailer). For example, as shown in FIG. 2B, a first lower link 27*t* has a top end pivotably connected to a lower end of the first intermediate link 26*t* and a bottom end releasably connected, e.g. with an insertable/removable pin 28*t*, to a lug 42*t*; and a second lower link 27*s* has a top end pivotably connected to a lower end of the second intermediate link 26*s* and a bottom end releasably connected, e.g. with an insertable/removable pin 28*s* to a lug 42*s*. Similar links and supports are associated with the other suspension arm and the other end of the structure 40, e.g. as referred to below, the doghouse 40.

Figure 2A:
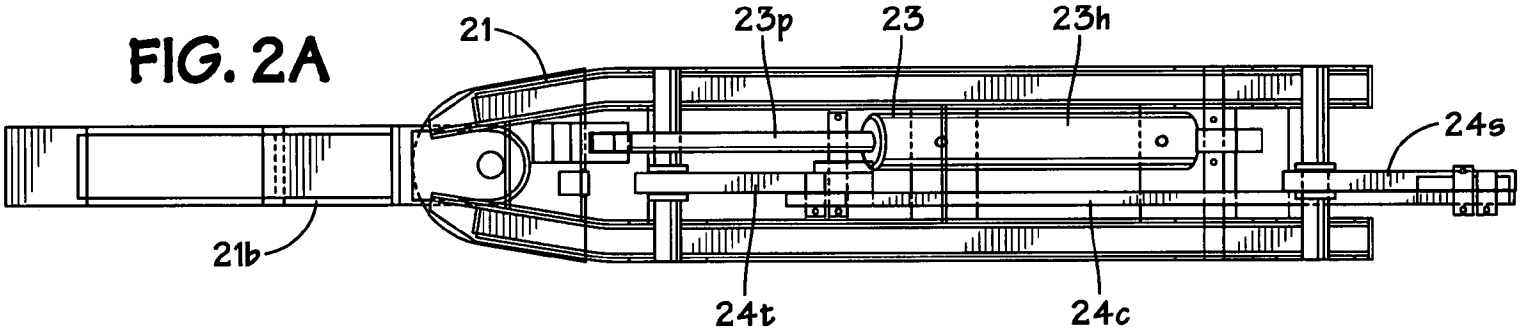
FIG. 2A is an enlarged top view of the rig of FIG. 1C.
Figure 2B:
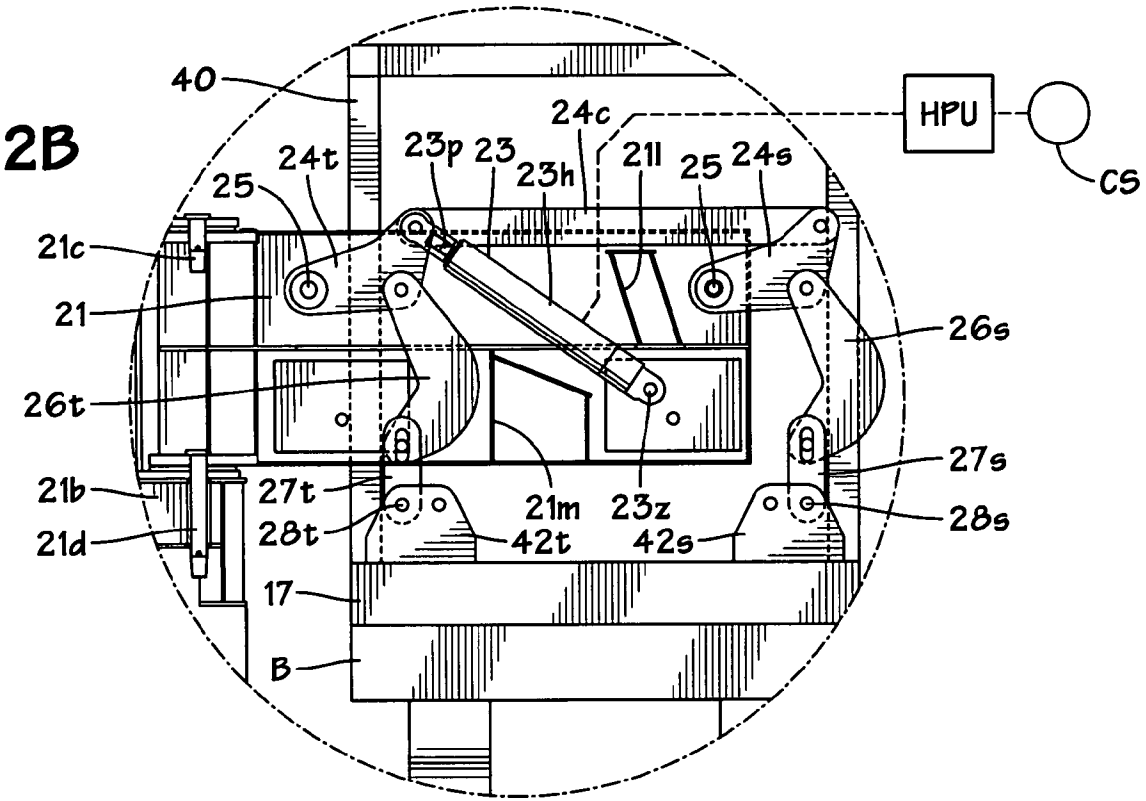
FIG. 2B is an enlarged side view of the rig of FIG. 1C.

As shown in FIG. 2A, the movable piston 23*p* is retracted. Hydraulic power fluid is supplied to the cylinder apparatus 23 from an hydraulic power unit HPU controlled by a control-system CS (shown schematically in FIG. 2B).

Figure 3A:
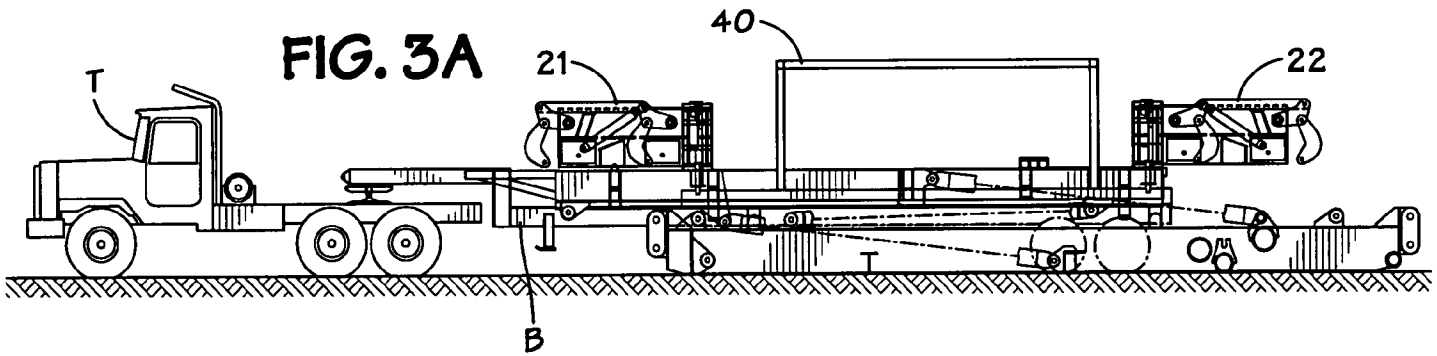
FIG. 3A is a side view illustrating a step of a method according to the present invention.
Figure 3B:
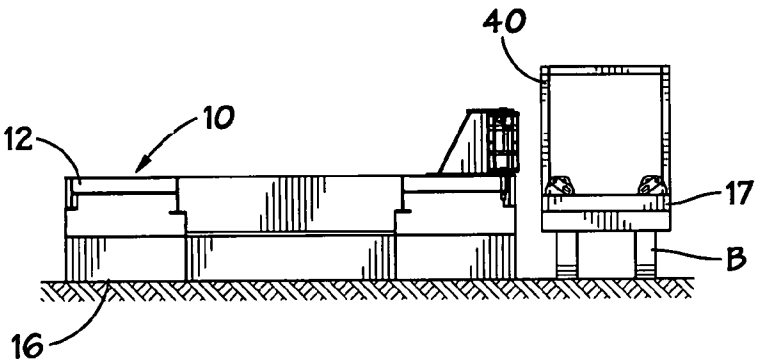
FIG. 3B is an end view of the step of FIG. 3A.
Figure 3C:
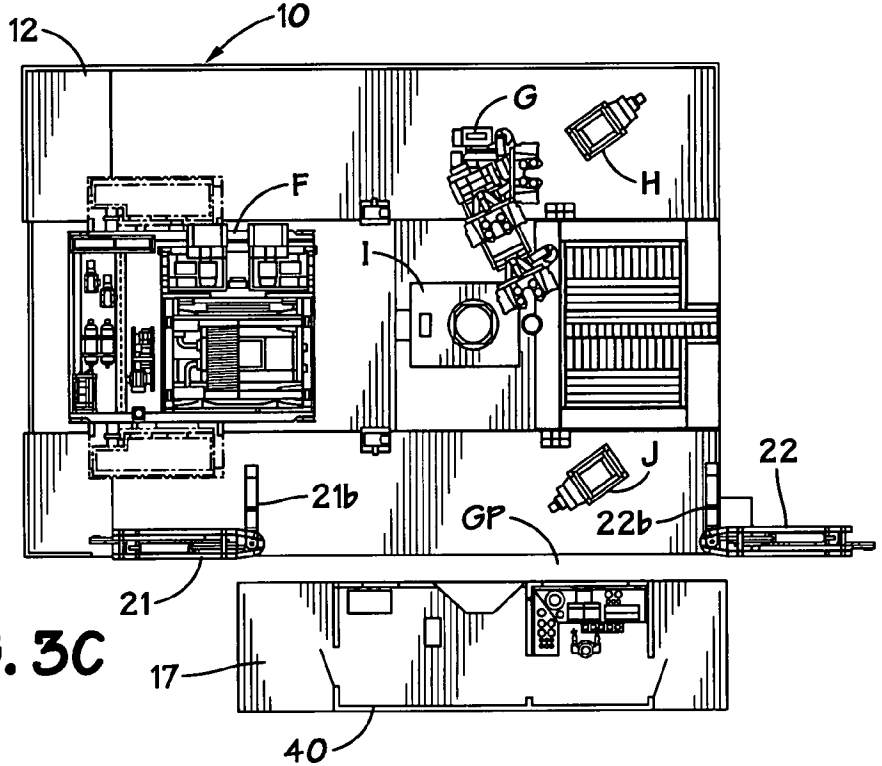
FIG. 3C is a top view of the step of FIG. 3A.

In one method according to the present invention, the truck T approaches the rig 10, with the doghouse 40 supported on a trailer B. The left (as viewed in FIG. 1C) suspending arm 22 is turned 180° (from its initial position as shown in FIG. 1C). With the left suspending arm 22 out of the way, the truck T is driven to position the doghouse 40 as shown in FIGS. 3A-3C.

Figure 4A:
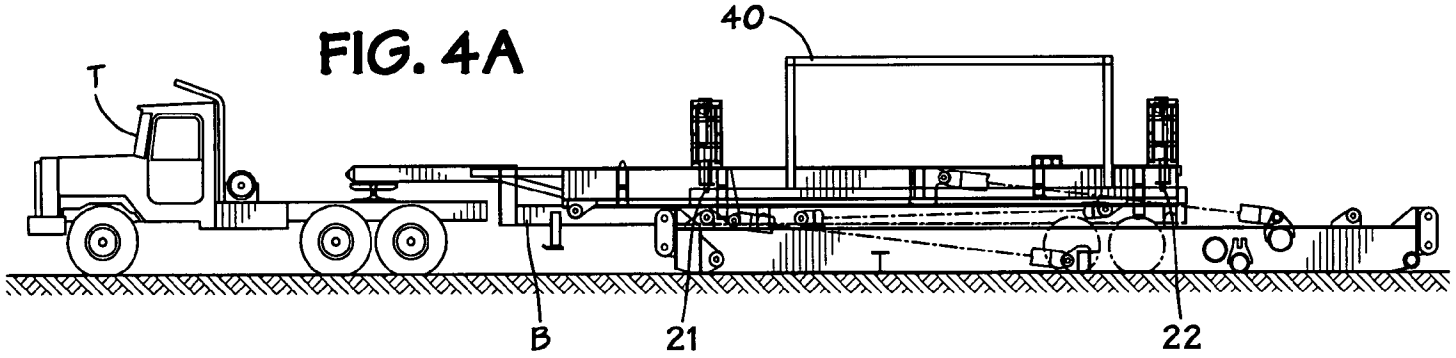
FIG. 4A is a side view illustrating a step in the method according to the present invention following the step of FIG. 3A.
Figure 4C:
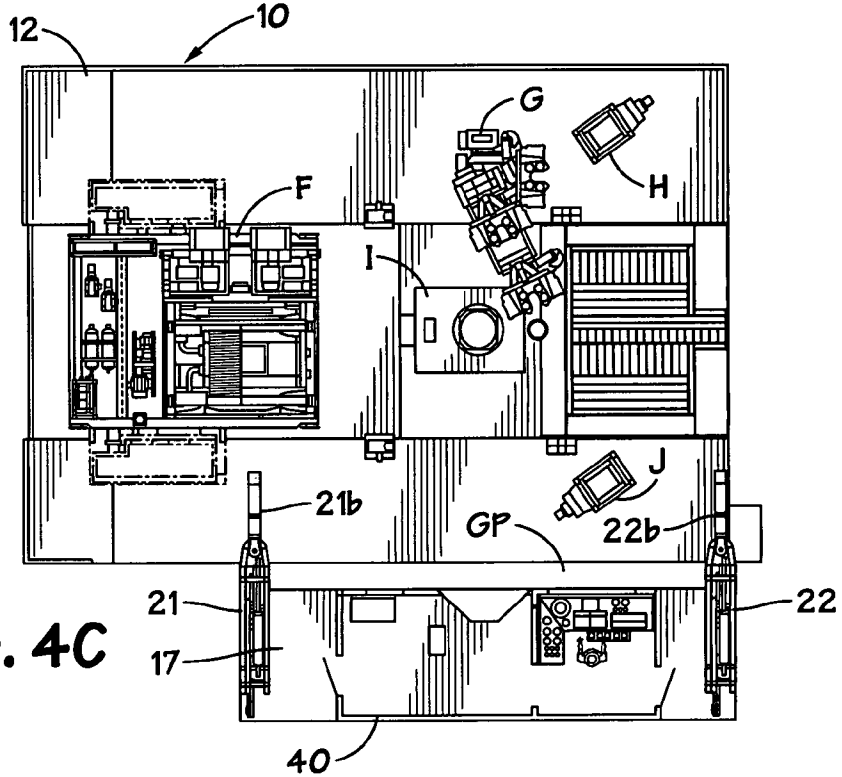
FIG. 4C is a top view illustrating the step of FIG. 4A.
Figure 4B:
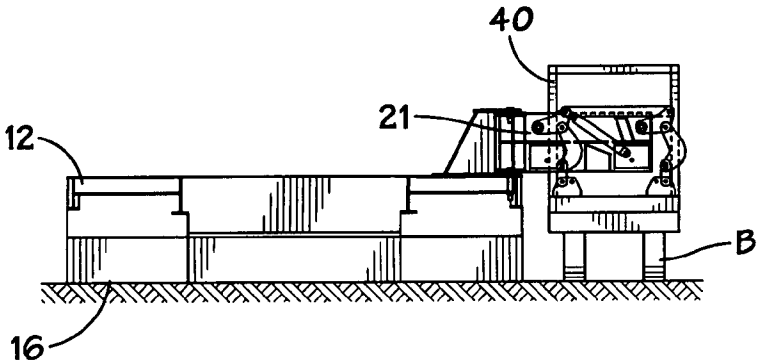
FIG. 4B is an end view of the step of FIG. 4A.
Figure 5A:
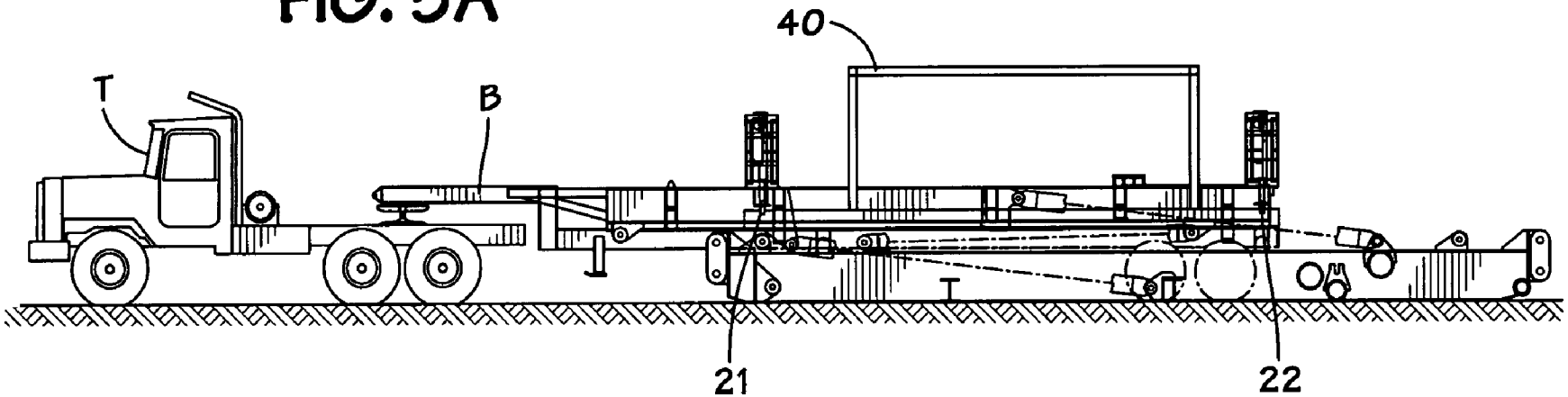
FIG. 5A is a side view illustrating a step in the method according to the present invention following the step of FIG. 4A.
Figure 5B:
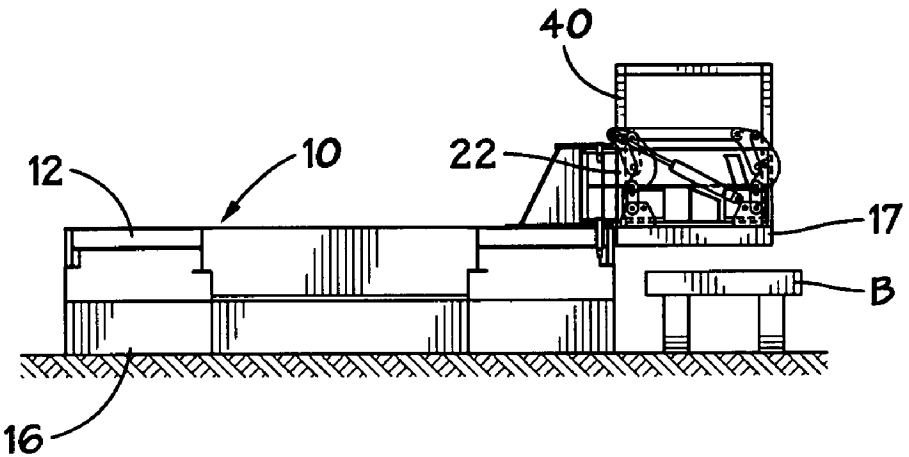
FIG. 5B is an end view of the step of FIG. 5A.

As shown in FIGS. 4A-4C, the arms 21, 22 are then turned 90° so they can be connected to the doghouse lugs 42*t*, 42*s*. The linkage assemblies are released (they are held in a fixed position for transport) and pins 28*t* and 28*s* are used to releasably connect the lower links 27*t*, 27*s* to the lugs 42*t*, 42*s*.

As shown in FIGS. 5A-5D, the movable piston 23*p* is then extended resulting in the rotation of the links 24*t*, 24*s*, 26*t*, and 26*s* to align the doghouse 40 parallel to the drill floor 12 and to raise the doghouse 40 off the trailer B. The skid 17 with the doghouse 40 is raised to a level flush with the drill floor 12.

Figure 6B:
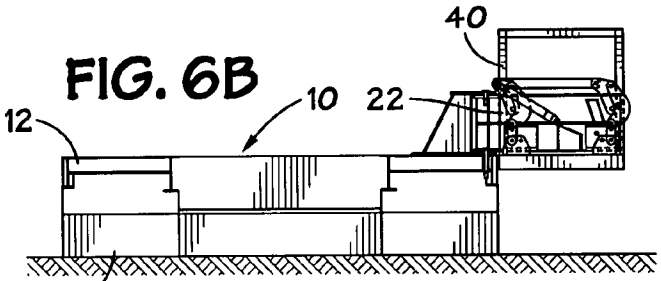
FIG. 6B is an end view illustrating the step of FIG. 6A.
Figure 6D:
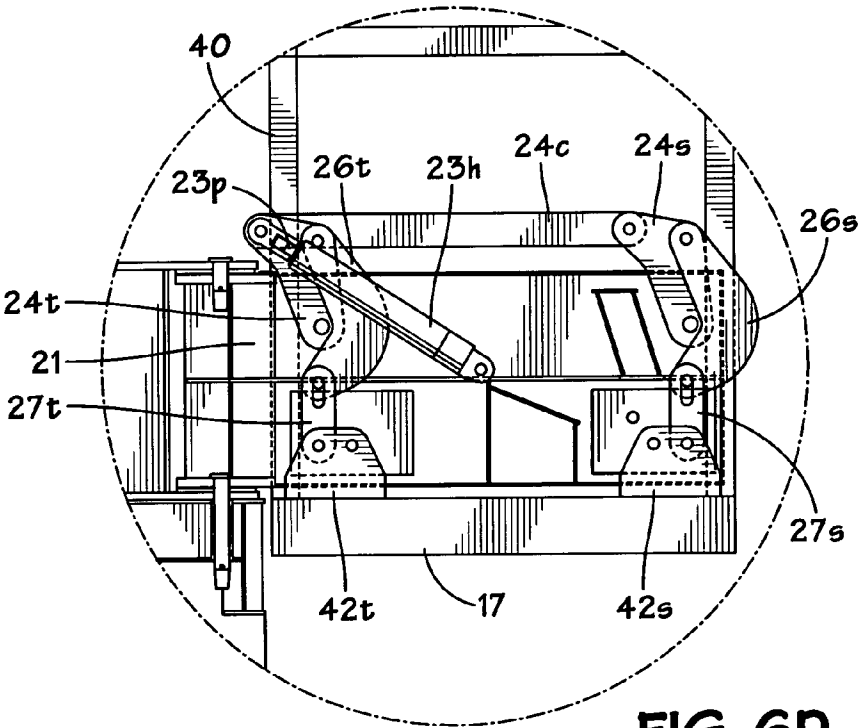
FIG. 6D is an enlarged view of part of the rig in the step of FIG. 6A.
Figure 6A:
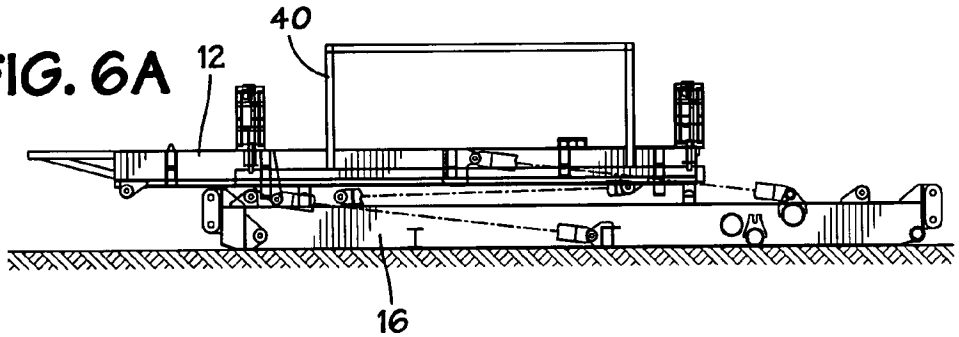
FIG. 6A is a side view illustrating a step in the method according to the present invention following the step of FIG. 5A.
Figure 6C:
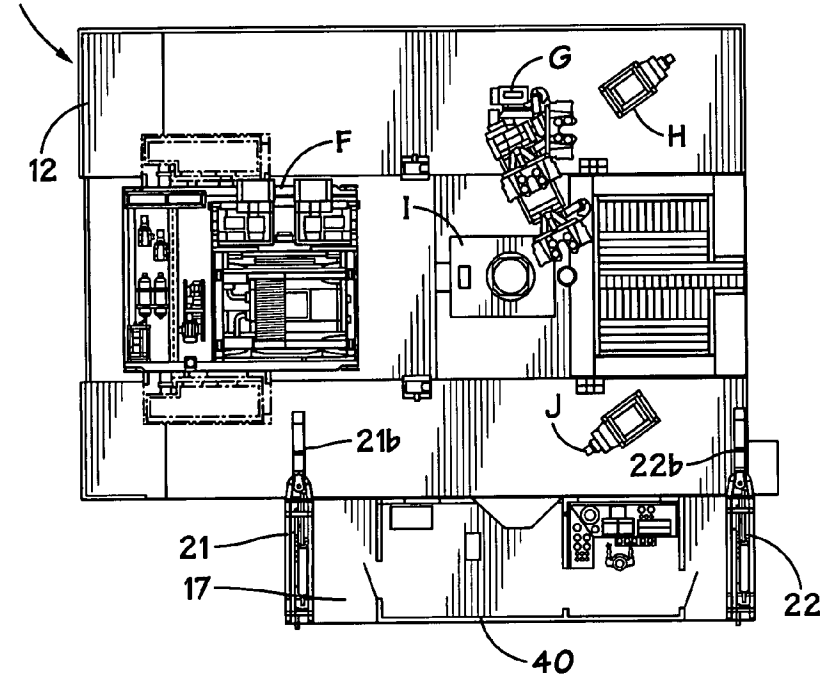
FIG. 6C is a top view of the step of FIG. 6A.

The skid 17 with the doghouse 40 is locked in place (see FIG. 6D) by inserting removable pins 29*t*, 29*s* through holes in the lugs 42*t*, 42*s* into corresponding holes in the arms 21, 22. The movable pistons 23*p* of both apparatuses 23 can be retracted and the truck T with the trailer B driven away (see FIGS. 6A-6C).

Figure 7C:
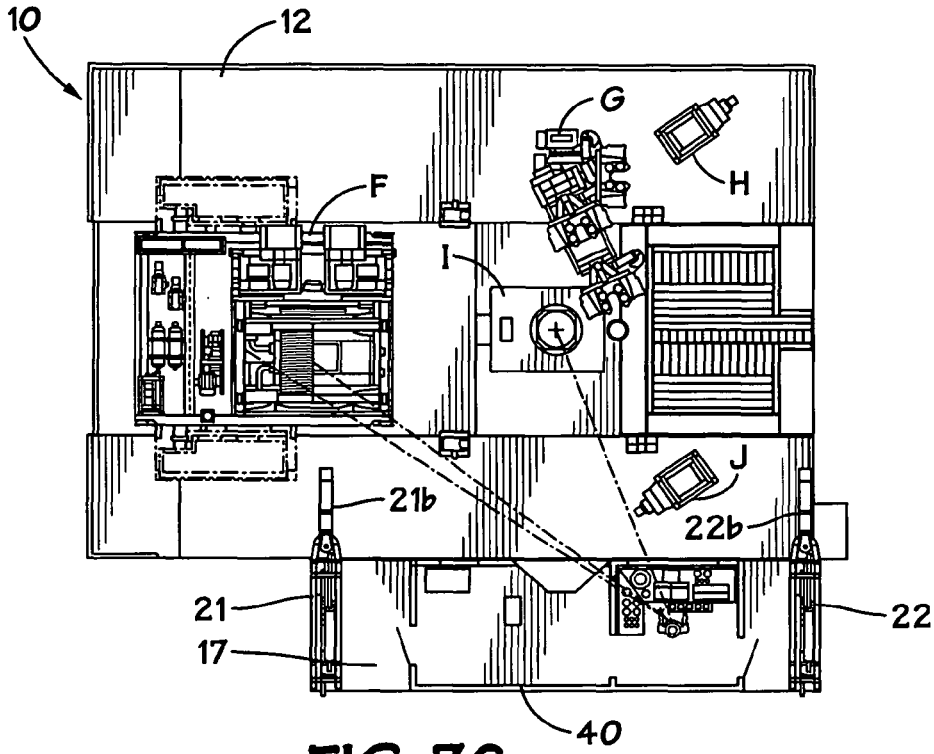
FIG. 7C is a top view of the rig of FIG. 7A.

As shown in FIGS. 7A-7C, the substructure 16 raises the drill floor 12 with the skid 17 and the doghouse 40. Since using the arms 21, 22 aligns the doghouse 40, it is not necessary for the skid 17 with the doghouse 40 to be perfectly parallel to the substructure 16 prior to lifting, and there can be a gap GP (see FIG. 3C) between the drill floor 12 and the doghouse 40.

FIGS. 8A-13C illustrate another system and method according to the present invention for installing a rig structure such as, but not limited to, a doghouse on a rig without a crane, cables, or drawworks. Instead of the linkage assemblies of the system as shown in FIG. 2B, a plurality of powered hydraulic cylinder assemblies are used to raise and move a skid with a doghouse.

Figure 8A:
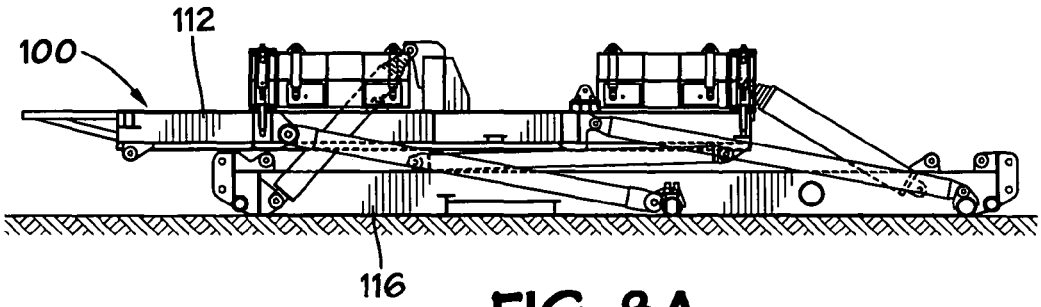
FIG. 8A is a side view of part of a drilling rig according to the present invention.
Figure 8B:
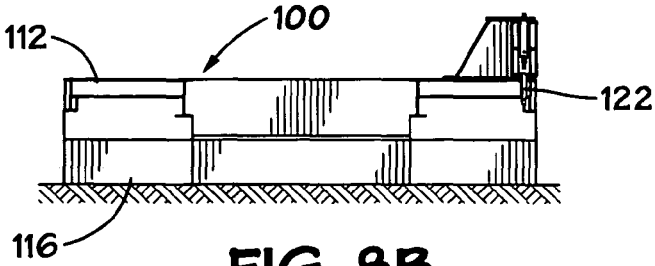
FIG. 8B is an end view of the rig FIG. 8A.
Figure 8C:
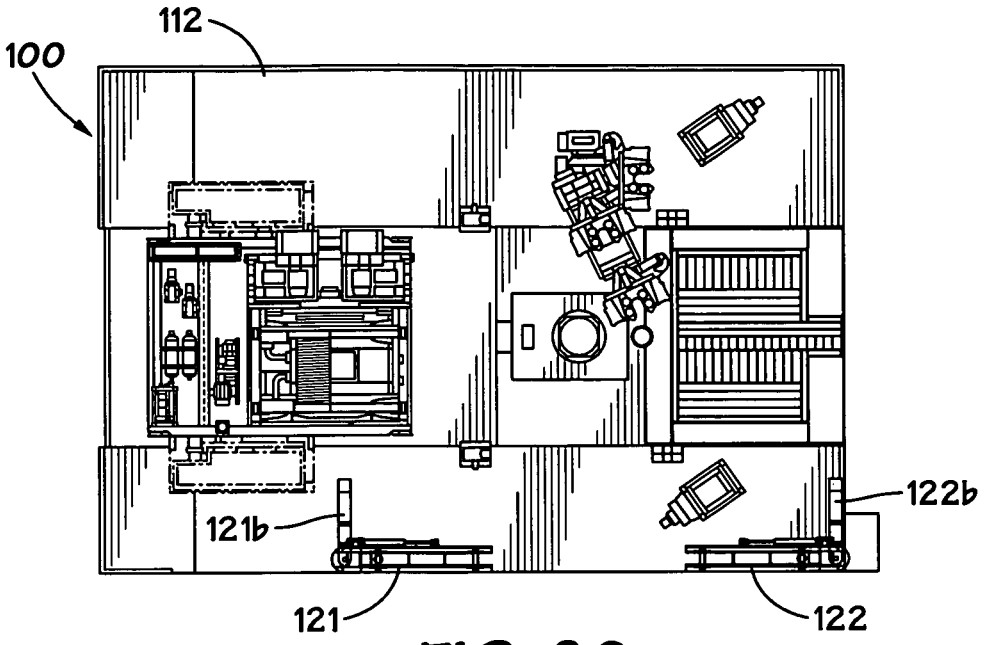
FIG. 8C is a top view of the rig of FIG. 8A.
Figure 8D:
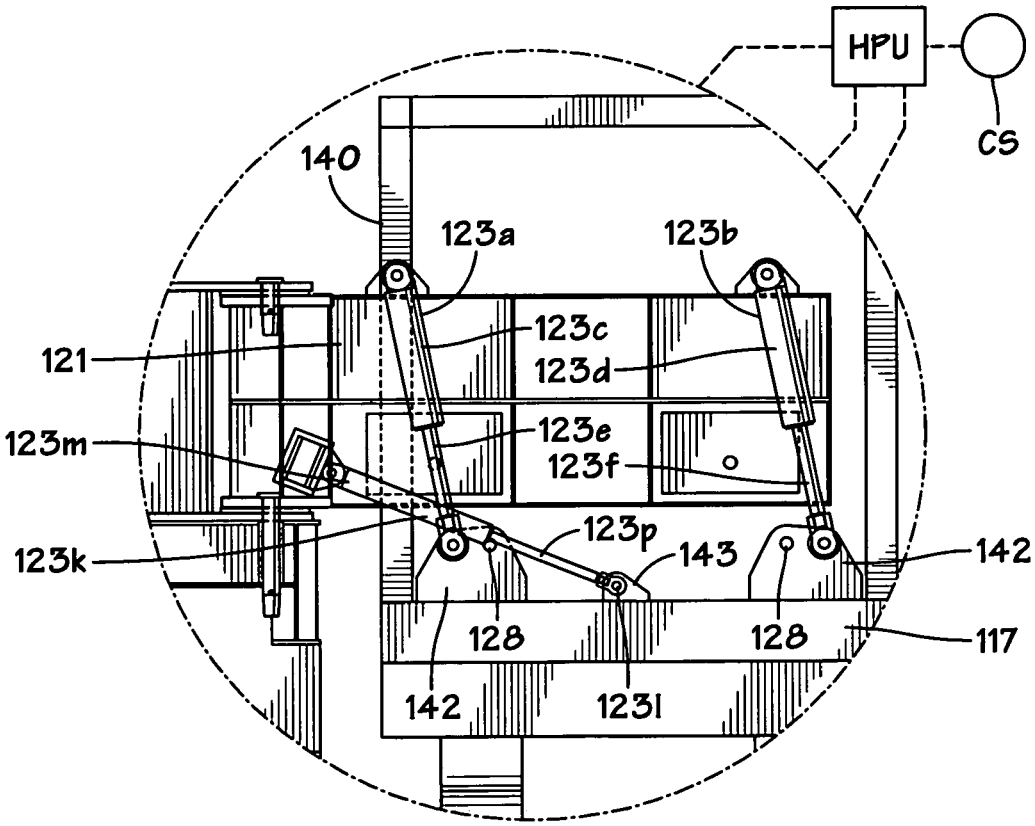
FIG. 8D is an enlarged side view of part of the rig of FIG. 8A.
Figure 8F:
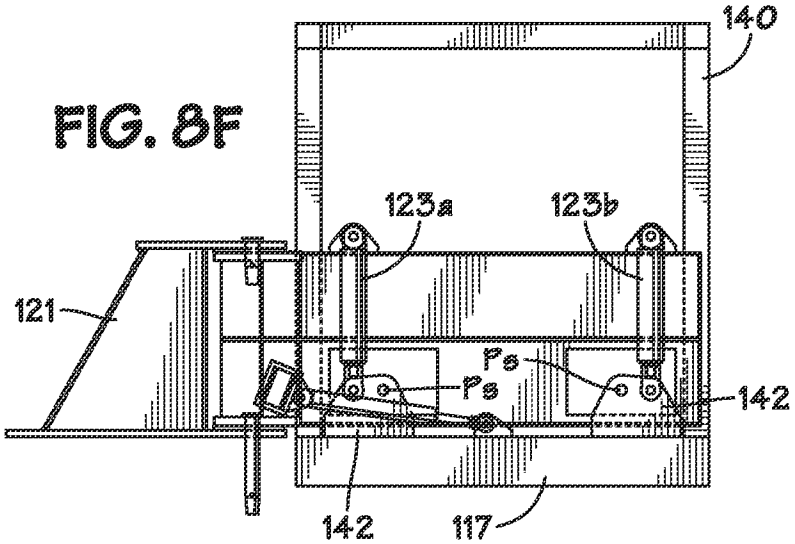
FIG. 8F is a side view of part of the rig of FIG. 8E.
Figure 8H:
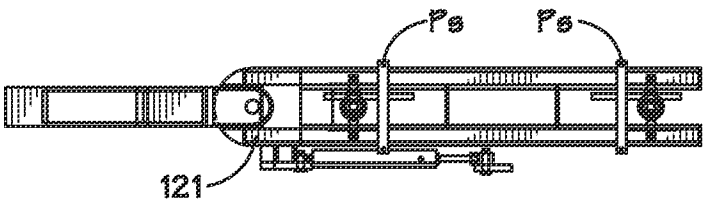
FIG. 8H is a top view of part of the rig shown in FIG. 8F.
Figure 8E:
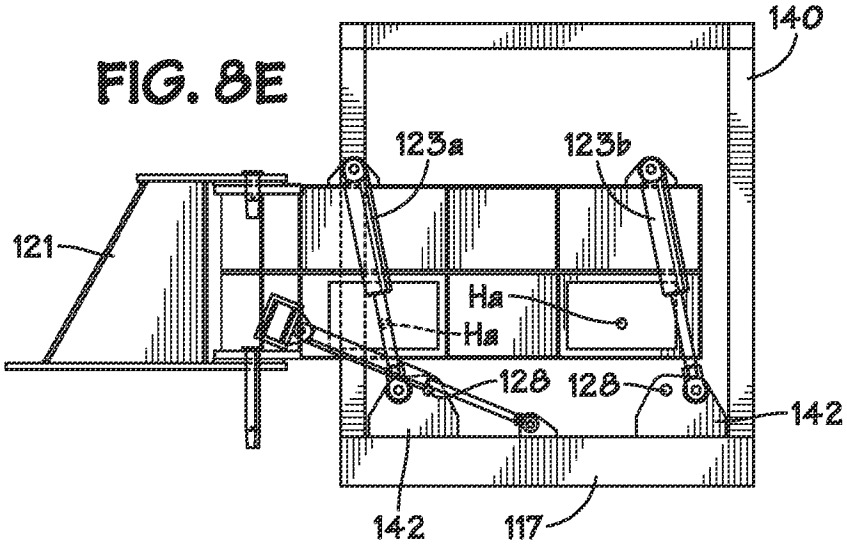
FIG. 8E is a side view of part of the rig of FIG. 8A.
Figure 8G:
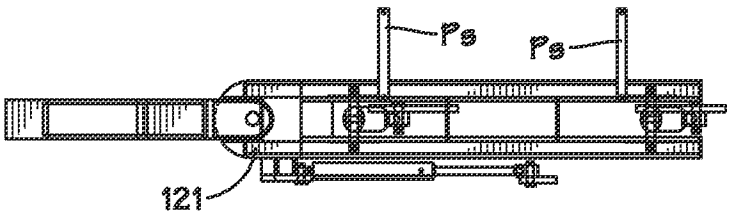
FIG. 8G is a top view of the rig shown in FIG. 8E.

FIGS. 8A, 8B, and 8C show a rig 100 with a drill floor 112 on a substructure 116 with rig equipment like the rig of FIG. 1A. Pivotably connected to the drill floor 112 are a left suspending arm 121 and a right suspending arm 122 on bases 121*b*, 122*b*, respectively. The bases are connected to the drill floor 112. FIG. 8D shows the left suspending arm 121. The right suspending arm 122 is like the left suspending arm. As shown in FIG. 8C the two suspending arms 121, 122 are directed toward each other, e.g. for travel.

The suspending arm 121, FIG. 8D, is pivotably connected to the base 121*b* which is secured to or formed integrally of the substructure 116. The arm 121 can pivot 180° on the base 121*b*. Each suspending arm 121 has two hydraulically-powered raising cylinder apparatuses 123*a* and 123*b* with housings 123*c*, 123*d* and extendable pistons 123*e*, 123*f*, respectively. A top end of each housing is pivotably connected to the arm 121 and a lower end of each piston is pivotably connected to a lug 142 on a skid 117 to which is secured a doghouse 140. Initially the doghouse 140 is supported on a trailer L of a truck R.

FIGS. 8E-8H illustrate the connection of the skid 117 to the suspending arms. The apparatuses 123*a*, 123*b* raise the skid 117 (and whatever is on the skid 117, e.g. a doghouse 140) so that the holes Ha of the arm are aligned with holes 128 of the lugs 142. Locking pins PS are then inserted through the holes to secure the skid 117 to the arm.

An hydraulically-powered cylinder apparatus 123*k* has a housing 123*m* pivotably connected to the arm 121 and an end of an extendable piston 123*p* pivotably connected with pins 123*l* to a lug 143 on the skid 117. Hydraulic power fluid is supplied to the three cylinder apparatuses from an hydraulic power unit HPU controlled by a control system CS (shown schematically).

FIGS. 9A-13C illustrate steps in a method according to the present invention for installing the doghouse 140 on the rig 100.

Figure 9A:
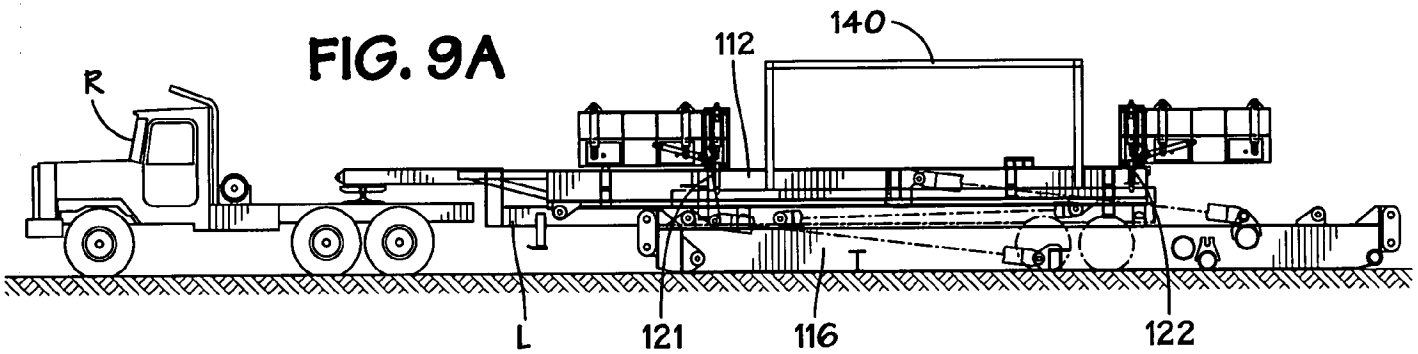
FIG. 9A is a side view illustrating a step of a method according to the present invention.
Figure 9C:
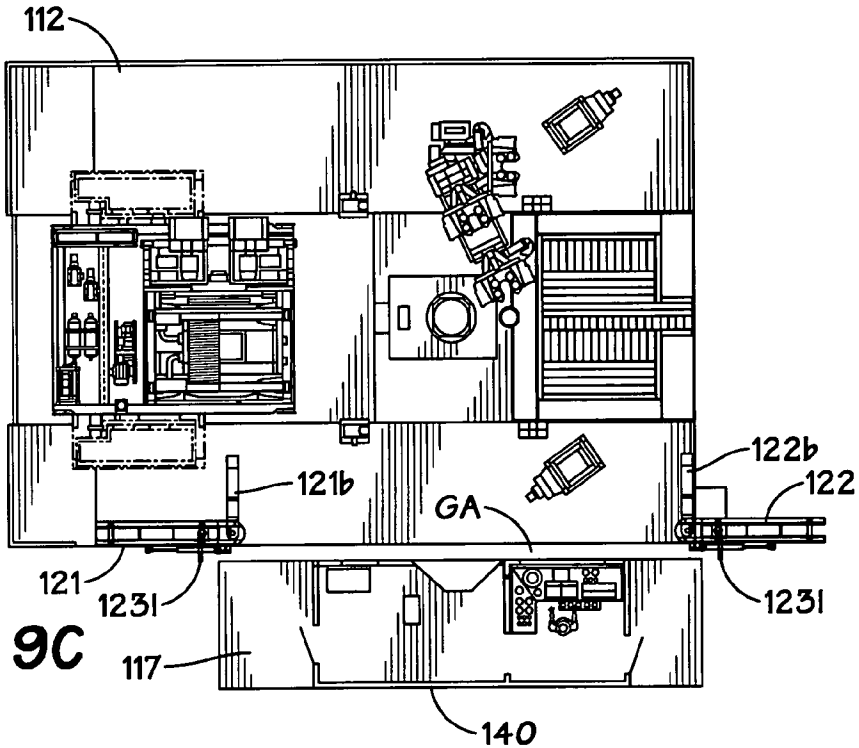
FIG. 9C is a top view of the step of FIG. 9A.
Figure 9B:
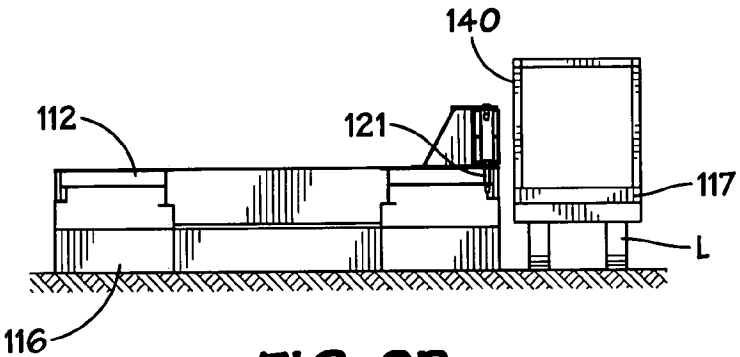
FIG. 9B is an end view of the step of FIG. 9A.

As shown in FIGS. 9A-9C, the arms 121, 122 are turned out 180° (as compared to their position in FIG. 8C). The cylinders 123*k* connected to the arms 121, 122 (used for removing the doghouse) are pinned in place when rotating the arms. The truck R is driven so the doghouse 140 is located between the arms 121, 122.

Figure 10A:
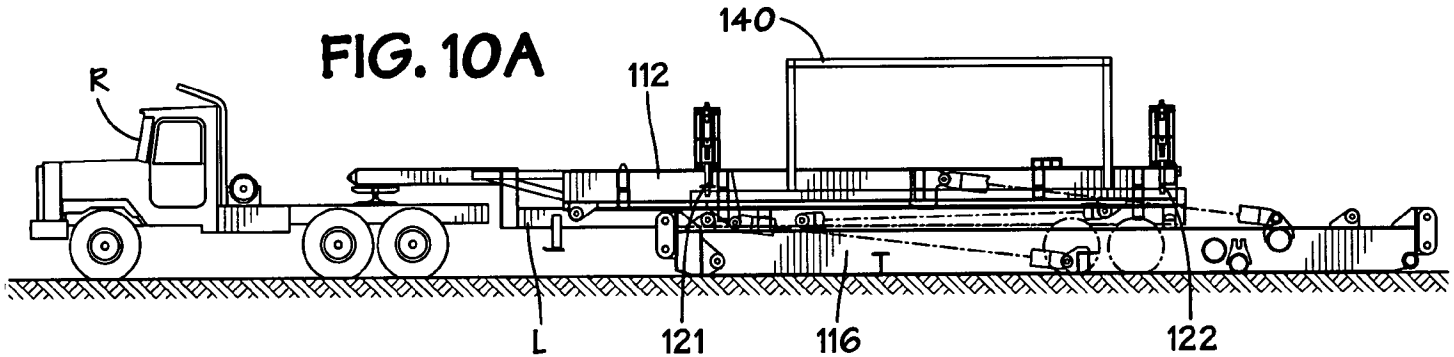
FIG. 10A is a side view illustrating a step in the method according to the present invention following the step of FIG. 9A.
Figure 10B:
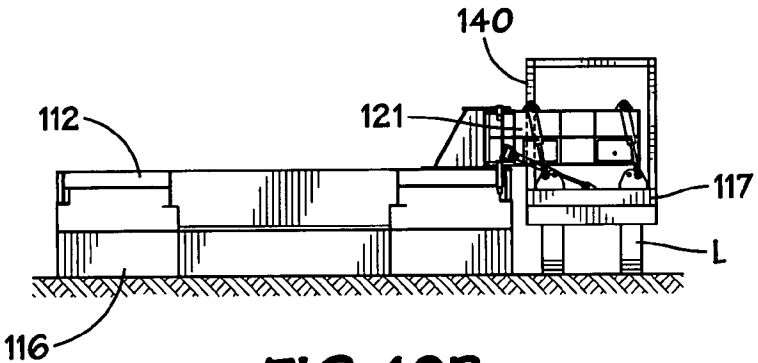
FIG. 10B is an end view of the step of FIG. 10A.
Figure 10C:
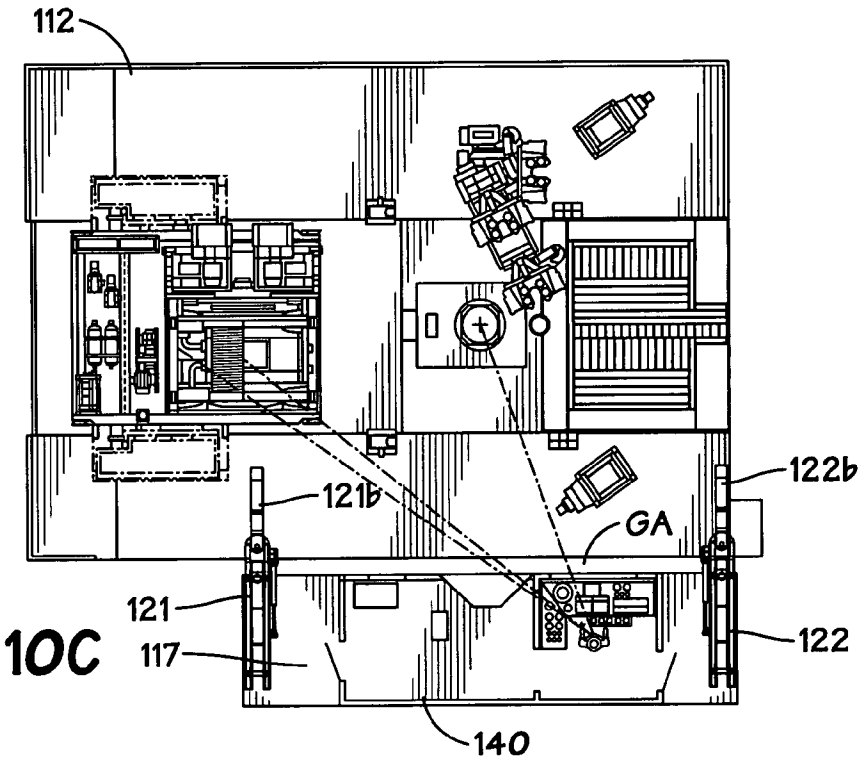
FIG. 10C is a top view illustrating the step of FIG. 10A.

As shown in FIGS. 10A-10C, the arms 121, 122 are turned 90° as shown and the lower ends of the pistons 123*e*, 123*f* are pivotably pinned to the lugs 142. The lower end of the piston 123*p* is pivotably pinned to the lug 143.

Figure 11A:
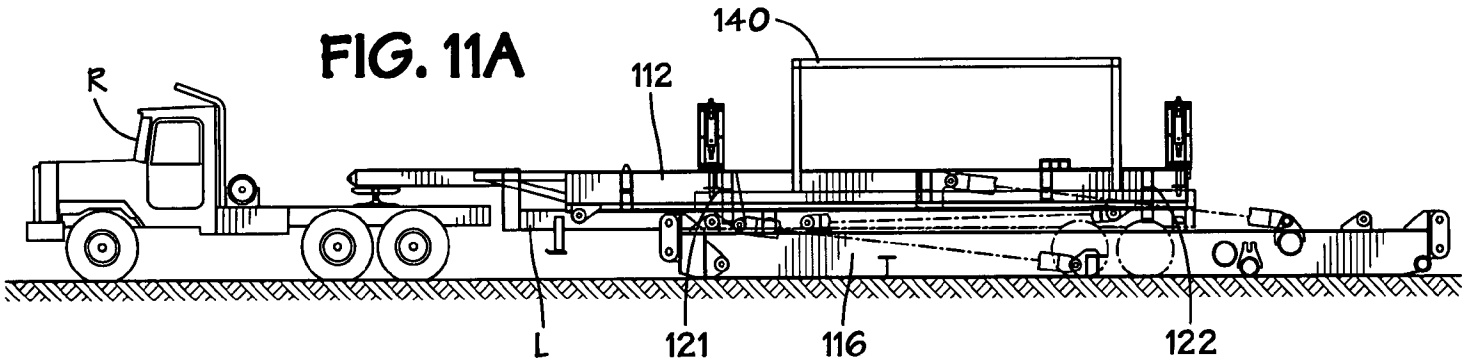
FIG. 11A is a side view illustrating a step in the method according to the present invention following the step of FIG. 10A.
Figure 11C:
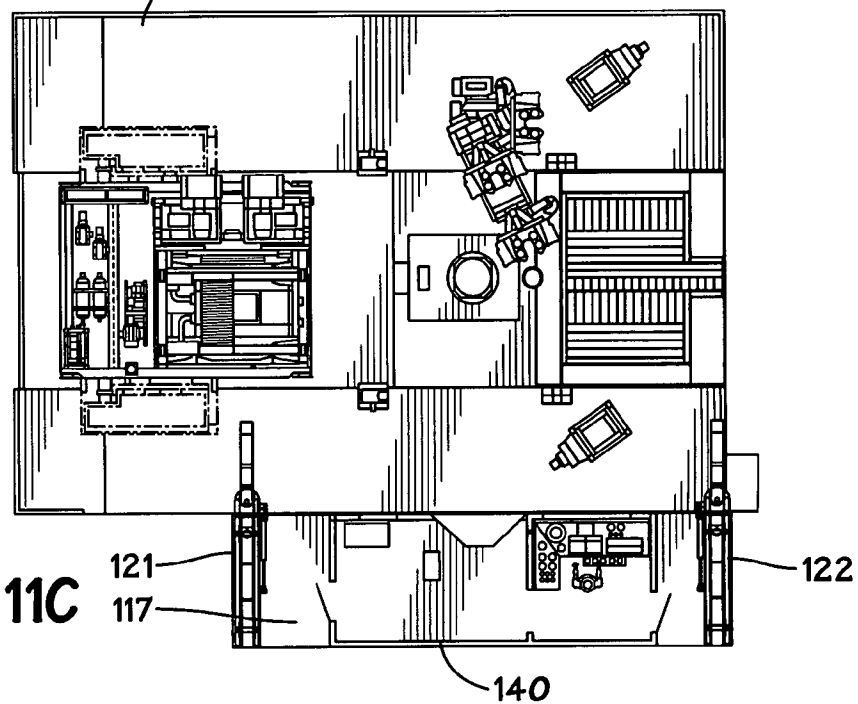
FIG. 11C is a top view of the step of FIG. 11A.
Figure 11B:
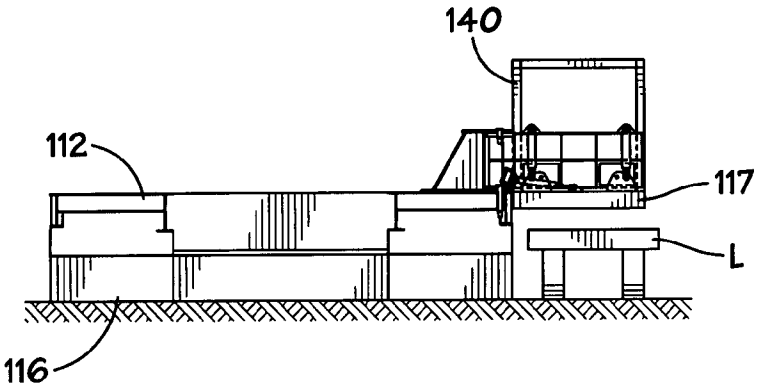
FIG. 11B is an end view of the step of FIG. 11A.

As shown in FIG. 11A-11C, the pistons 123*p* are retracted, controlling movement of the skid 117 with the doghouse 140 until it is between the arms 121, 122 and then the raising cylinder apparatuses 123*a*, 123*b* retract their pistons 123*e*, 123*f* to raise the doghouse 140 so that the top of the skid 117 is flush with the drill floor 112. An initial gap GA between the skid 117 with the doghouse 140 and the drill floor 112, if present, is eliminated as the doghouse 140 moves to the drill floor 112.

Figure 12A:
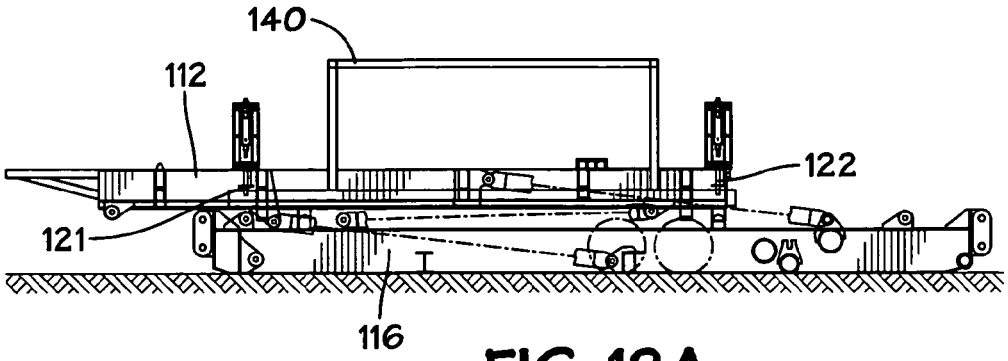
FIG. 12A is a side view illustrating a step in the method according to the present invention following the step of FIG. 11A.
Figure 12B:
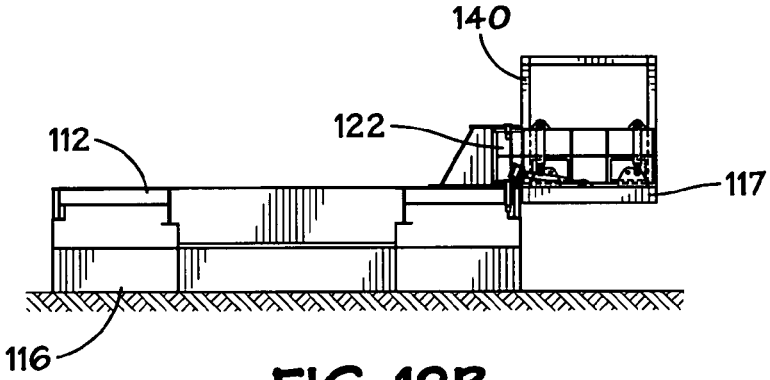
FIG. 12B is an end view illustrating the step of FIG. 12A.
Figure 12C:
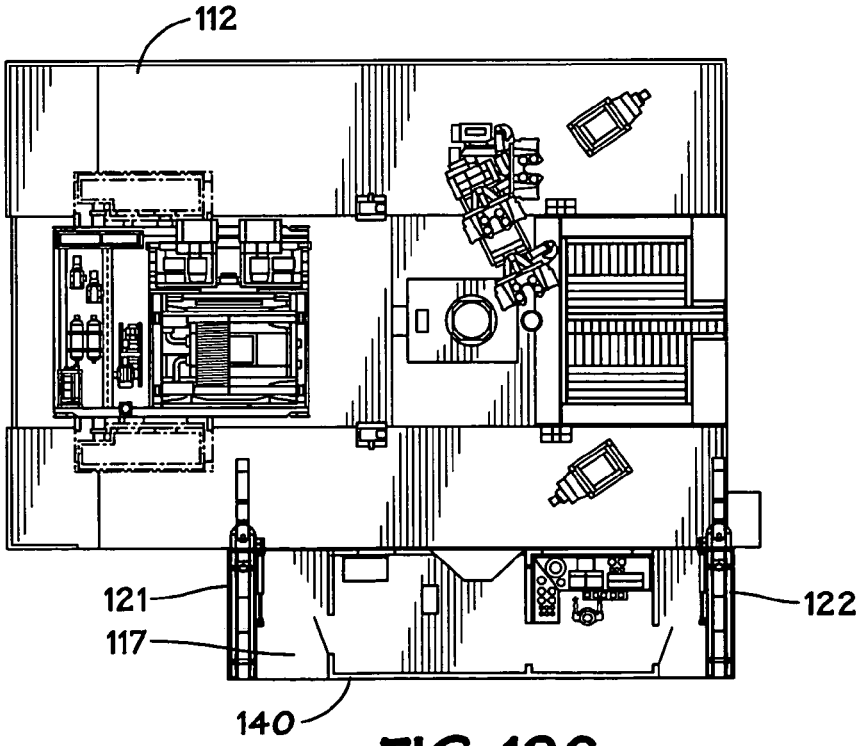
FIG. 12C is a top view of the step of FIG. 12A.

The skid 117 with the doghouse 140 is locked in place as shown in FIGS. 12A-12C by inserting pins through holes 128 in the lugs 142 into corresponding holes in the arms 121, 122. For storage, power to the cylinders is turned off. Once the skid 117 with the doghouse 140 is connected to the arms 121, 122, the truck R with the trailer A is driven away.

Figure 13C:
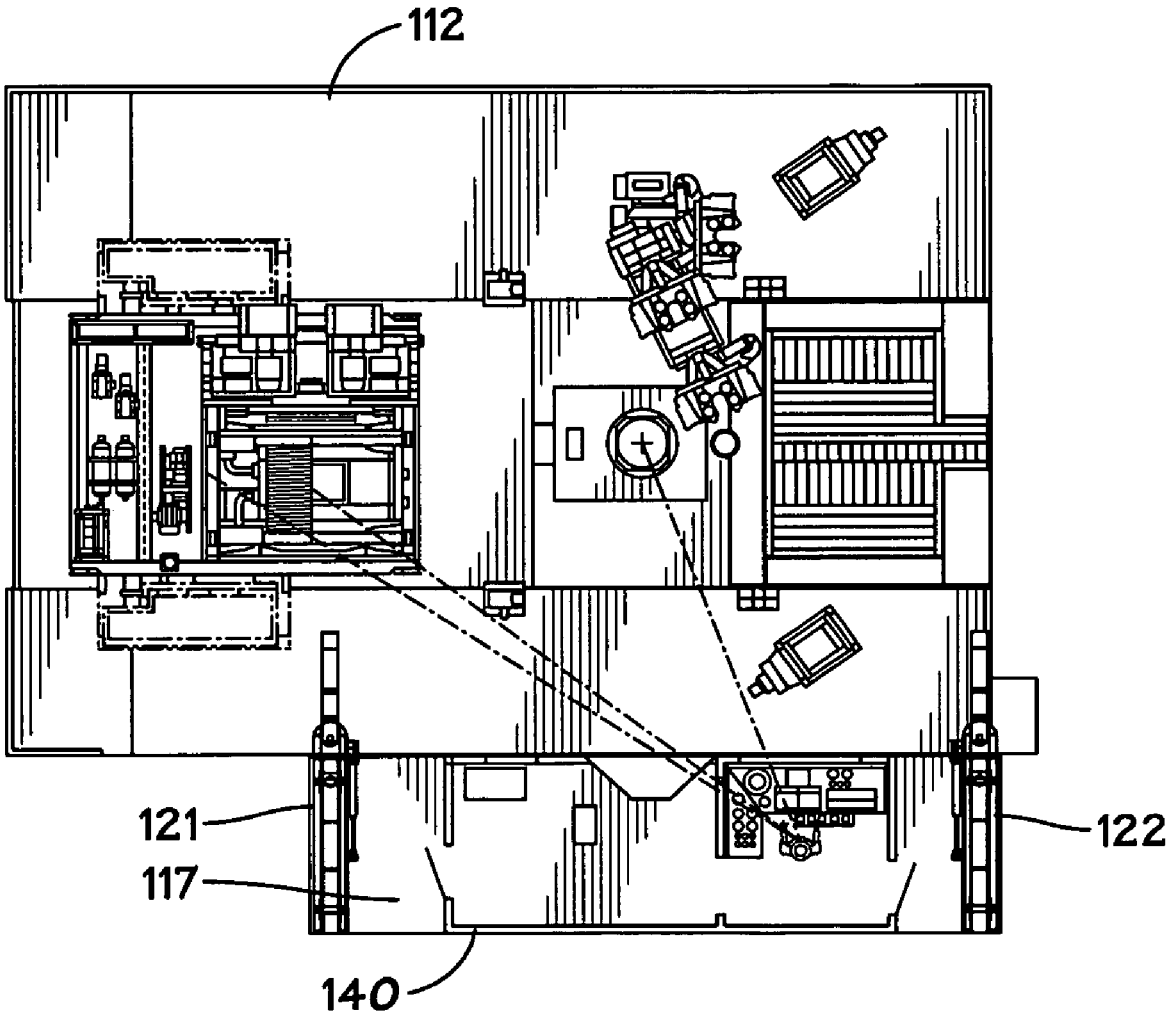
FIG. 13C is a top view of the rig of FIG. 13A.

FIGS. 13A-13C show the drill floor 112 with the doghouse 140 installed thereon raised by the substructure 116.

The present invention, therefore, provides in some, but not in necessarily all, embodiments a method for installing a rig structure on a drilling rig, the method including: positioning a rig structure on a movement apparatus adjacent a support apparatus, the support apparatus connected to a substructure of a drilling rig, the support apparatus movably connected to the substructure, the substructure supporting a drilling floor, said positioning effected by moving the movement apparatus on ground adjacent the substructure; moving the support apparatus into a connecting orientation with respect to the rig structure, the support apparatus having raising apparatus connected thereto; connecting the raising apparatus to the rig structure; and raising the rig structure with the raising apparatus. Such a method may one or some, in any possible combination, of the following: wherein the rig structure is one of house, doghouse, cabin, driller cabin, and electrical control house; raising the rig structure up to the drill floor and securing the rig structure to the support apparatus; wherein the support apparatus includes dual opposed support arms, each arm pivotably connected to a corresponding base connected to the drilling floor, the method further including positioning each of the dual opposed support arms at an angle to its respective base to facilitate positioning of the rig structure adjacent the drilling floor; moving the dual opposed support arms toward the rig structure for connection thereto, and connecting the dual opposed support arms to the rig structure; aligning the rig structure with respect to the support apparatus, and with the raising apparatus, raising the rig structure above the movement apparatus; removing the movement apparatus away from the drilling rig; raising, with the substructure, the drilling floor with the rig structure thereon; the raising apparatus including linkage apparatus connectable between the dual opposed support arms and the rig structure, and hydraulic cylinder apparatus interconnected between the dual support arms and the linkage apparatus for raising the linkage apparatus to raise the rig structure; the linkage apparatus including two spaced-apart linkages each with multiple links, each with a lowermost link connectable to the rig structure, the two spaced-apart linkages including a first linkage and a second linkage, a common link interconnecting the two linkages, and the hydraulic cylinder apparatus having a first end and a second end, the first end connected to one of the dual opposed support arms and the second end connected to the first linkages, the method further including extending the hydraulic cylinder apparatus to raise the first linkage and, via the common link, to thereby raise the second linkage; the raising apparatus including hydraulic cylinder apparatus releasably interconnecting the dual opposed support arms and the rig structure, the method further including raising the rig structure by contacting the hydraulic cylinder apparatus; and/or the raising apparatus including hydraulic cylinder, the hydraulic cylinder apparatus interconnected between the support apparatus and the rig structure, the method further including contracting the hydraulic cylinder apparatus to move the rig structure toward the drilling floor.

The present invention, therefore, provides in some, but not in necessarily all, embodiments a method for installing a rig structure on a drilling rig, the method including: positioning a rig structure on a movement apparatus adjacent a support apparatus, the support apparatus connected to a substructure of a drilling rig, the support apparatus movably connected to the substructure, the substructure supporting a drilling floor, said positioning effected by moving the movement apparatus on ground adjacent the substructure; moving the support apparatus into a connecting orientation with respect to the rig structure, the support apparatus having raising apparatus connected thereto; connecting the raising apparatus to the rig structure; raising the rig structure with the raising apparatus up to the drill floor; wherein the rig structure is one of house, doghouse, cabin, driller cabin, and electrical control house; wherein the support apparatus includes dual opposed support arms, each arm pivotably connected to a corresponding base connected to the drilling floor, the method further including positioning each of the dual opposed support arms at an angle to its respective base to facilitate positioning of the rig structure adjacent the drilling floor; removing the movement apparatus away from the drilling rig; and raising, with the substructure, the drilling floor with the rig structure thereon.

The present invention, therefore, provides in some, but not in necessarily all, embodiments a handling system for securing a rig structure to a drilling rig, the handling system including movement apparatus for initially supporting a rig structure and for moving on ground adjacent a drilling rig to position the rig structure with respect to the drilling rig, the drilling rig having a substructure with a drill floor; support apparatus movably connected to the drill floor for selectively supporting the rig structure, the support apparatus movable out of the way to facilitate positioning of the rig structure with respect to the drill floor and the support apparatus movable adjacent the rig structure for connection thereto; and raising apparatus connected to the support apparatus, the raising apparatus for selectively raising the rig structure with respect to the drill floor. Such a system may one or some, in any possible combination, of the following: wherein the rig structure is one of house, doghouse, cabin, driller cabin, and electrical control house; wherein the support apparatus includes dual opposed support arms, each arm pivotably connected to a corresponding base connected to the drilling floor, and each of the dual opposed support arms positionable at an angle to its respective base to facilitate positioning of the rig structure adjacent the drilling floor; the raising apparatus including linkage apparatus connectable between the dual opposed support arms and the rig structure, and hydraulic cylinder apparatus interconnected between the dual support arms and the linkage apparatus for raising the linkage apparatus to raise the rig structure; the linkage apparatus including two spaced-apart linkages each with multiple links, each with a lowermost link connectable to the rig structure, the two spaced-apart linkages including a first linkage and a second linkage, a common link interconnecting the two linkages, and the hydraulic cylinder apparatus having a first end and a second end, the first end connected to one of the dual opposed support arms and the second end connected to the first linkage so that extending the hydraulic cylinder apparatus raises the first linkage and, via the common link, thereby raises the second linkage; the raising apparatus including hydraulic cylinder apparatus releasably interconnecting the dual opposed support arms and the rig structure so that by contracting the hydraulic cylinder apparatus raises the rig structure; and/or the raising apparatus including hydraulic cylinder apparatus, the hydraulic cylinder apparatus interconnected between the support apparatus and the rig structure so that contracting the hydraulic cylinder apparatus moves the rig structure toward the drilling floor.

The systems and methods of the inventions described in the following pending U.S. patent applications, co-owned with the present invention, filed on even date herewith, naming Donnally et al as inventors, and fully incorporated herein for all purposes, may be used with certain embodiments of the present invention, the applications entitled: "Drilling Rig Masts And Methods Of Assembly and Erection"; "Drilling Rig Drawworks Installation"; and "Drilling Rigs and Erection Methods".

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes. It is the express intention of the applicant not to invoke 35 U.S.C. § 112, paragraph 6 for any limitations of any of the claims herein, except for those in which the claim expressly uses the words 'means for' together with an associated function. In this patent document, the word "comprising" is used in its non-limiting sense to mean that items following the word are including, but items not specifically mentioned are not excluded. A reference to an element by the indefinite article "a" does not exclude the possibility that more than one of the element is present, unless the context clearly requires that there be one and only one of the elements.

What is claimed is:

1. A method for installing a rig structure on a drilling rig, the method comprising positioning a rig structure on a movement apparatus adjacent a support apparatus, the support apparatus being movably connected to a substructure of a drilling rig, the substructure supporting a drilling floor, said positioning effected by moving the movement apparatus on ground adjacent the substructure, moving the support apparatus into a connecting orientation with respect to the rig structure, the support apparatus having raising apparatus connected thereto, connecting the raising apparatus to the rig structure, and raising the rig structure with the raising apparatus, wherein the rig structure is substantially maintained in an operating orientation while being raised.

2. The method of claim 1 wherein the rig structure is one of a house, a doghouse, a cabin, a driller cabin, and an electrical control house.

3. The method of claim 1 further comprising raising the rig structure up to the drilling floor and securing the rig structure to the support apparatus.

4. The method of claim 1 wherein the support apparatus includes dual opposed support arms, each arm being pivotably connected to a corresponding base connected to the drilling floor, the method further comprising positioning each of the dual opposed support arms at an angle relative to its respective base to facilitate positioning of the rig structure adjacent the drilling floor.

5. The method of claim 4 further comprising moving the dual opposed support arms toward the rig structure for connection thereto, and connecting the dual opposed support arms to the rig structure.

6. The method of claim 5 further comprising aligning the rig structure with respect to the support apparatus, and with the raising apparatus, raising the rig structure above the movement apparatus.

7. The method of claim 6 further comprising removing the movement apparatus away from the drilling rig.

8. The method of claim 7 further comprising raising, with the substructure, the drilling floor with the rig structure thereon.

9. A method for installing a rig structure on a drilling rig, the method comprising positioning a rig structure on a movement apparatus adjacent a support apparatus, the support apparatus being movably connected to a substructure of a drilling rig, the substructure supporting a drilling floor, said positioning effected by moving the movement apparatus on ground adjacent the substructure, moving the support apparatus into a connecting orientation with respect to the rig structure, the support apparatus having raising apparatus connected thereto, connecting the raising apparatus to the rig structure, raising the rig structure with the raising apparatus up to the drilling floor while substantially maintaining said rig structure in an operating orientation, wherein the rig structure is one of a house, a doghouse, a cabin, a driller cabin, and an electrical control house, wherein the support apparatus includes dual opposed support arms, each arm pivotably connected to a corresponding base connected to the drilling floor, the method further comprising positioning each of the dual opposed support arms at an angle relative to its respective base to facilitate positioning of the rig structure adjacent the drilling floor, removing the movement apparatus away from the drilling rig, and raising, with the substructure, the drilling floor with the rig structure thereon.

10. A system comprising:

a substructure of a drilling rig, said substructure comprising a drilling floor, a rig structure that is adapted to be secured to the substructure, and a handling system that is adapted to secure said rig structure to said substructure, the handling system comprising:

movement apparatus for initially supporting said rig structure and for moving on ground adjacent said substructure to position the rig structure with respect to said substructure support apparatus movably connected to the drilling floor for selectively supporting the rig structure, the support apparatus movable out of the way to facilitate positioning of the rig structure with respect to the drilling floor and the support apparatus movable adjacent the rig structure for connection thereto, and raising apparatus connected to the support apparatus, wherein the raising apparatus is adapted for selectively raising the rig structure with respect to the drilling floor while substantially maintaining said rig structure in an operating orientation.

11. The handling system of claim 10 wherein the rig structure is one of a house, a doghouse, a cabin, a driller cabin, and an electrical control house.

12. The system of claim 10 wherein the support apparatus of said handling system includes dual opposed support arms, each arm pivotably connected to a corresponding base connected to the drilling floor, and each of the dual opposed support arms positionable at an angle to its respective base to facilitate positioning of the rig structure adjacent the drilling floor.

13. The system of claim 12 wherein the raising apparatus of said handling system includes linkage apparatus connectable between the dual opposed support arms and the rig structure, and hydraulic cylinder apparatus interconnected between the dual support arms and the linkage apparatus for raising the linkage apparatus to raise the rig structure.

14. The system of claim 13 wherein the linkage apparatus of said handling system includes two spaced-apart linkages each with multiple links, each with a lowermost link connectable to the rig structure, the two spaced-apart linkages including a first linkage and a second linkage, a common link interconnecting the two linkages, and the hydraulic cylinder apparatus having a first end and a second end, the first end connected to one of the dual opposed support arms and the second end connected to the first linkage so that extending the hydraulic cylinder apparatus raises the first linkage and, via the common link, thereby raises the second linkage.

15. The handling system of claim 12 wherein the raising apparatus of said handling system includes hydraulic cylinder apparatus releasably interconnecting the dual opposed support arms and the rig structure so that by contracting the hydraulic cylinder apparatus raises the rig structure.

16. The system of claim 10 wherein the raising apparatus of said handling system includes hydraulic cylinder apparatus, the hydraulic cylinder apparatus is interconnected between the support apparatus and the rig structure so that contracting the hydraulic cylinder apparatus moves the rig structure toward the drilling floor.

17. The method of claim 1, wherein the rig structure is a skid-mounted rig structure, and wherein raising the skid-mounted rig structure comprises raising the skid-mounted rig structure so that a floor of the skid-mounted rig structure is substantially flush with the drilling floor.

18. The system of claim 10, wherein the rig structure is a skid-mounted rig structure, and wherein the raising apparatus of said handling system is adapted to raise the skid-mounted rig structure so that a floor of the skid-mounted rig structure is substantially flush with the drilling floor.

19. A method for installing a rig structure on a drilling rig, the method comprising:

placing a rig structure on a movement apparatus;

moving said movement apparatus on ground adjacent to a substructure of a drilling rig to position said rig structure adjacent to a support apparatus that is movably connected to said substructure, wherein said support apparatus has a raising apparatus comprising a linkage apparatus and a hydraulic cylinder apparatus connected thereto, wherein said support apparatus comprises dual opposed support arms that are each pivotably connected to a respective base, wherein each respective base is connected to a drilling floor supported by said substructure, wherein said hydraulic cylinder apparatus is interconnected between said dual opposed support arms and said linkage apparatus, and wherein positioning said rig structure further comprises positioning each of said dual opposed arms at an angle relative to said respective base so as to facilitate said positioning of said rig structure adjacent to said drilling floor;

moving said support apparatus into a connecting orientation with respect to said rig structure;

connecting said raising apparatus to said rig structure, wherein connecting said raising apparatus to said rig structure comprises connecting said linkage apparatus between said dual opposed support arms and said rig structure; and raising said rig structure with said raising apparatus, wherein raising said rig structure comprises raising said linkage apparatus by actuating said hydraulic cylinder apparatus, said rig structure being substantially maintained in an operating orientation while being raised.

20. The method of claim 19 wherein the linkage apparatus includes two spaced-apart linkages each with multiple links, each with a lowermost link connectable to the rig structure, the two spaced-apart linkages including a first linkage and a second linkage, a common link interconnecting the two linkages, and the hydraulic cylinder apparatus having a first end and a second end, the first end connected to one of the dual opposed support arms and the second end connected to the first linkages, the method further comprising extending the hydraulic cylinder apparatus to raise the first linkage and, via the common link, to thereby raise the second linkage.

21. A method for installing a rig structure on a drilling rig, the method comprising:

placing a rig structure on a movement apparatus;

moving said movement apparatus on ground adjacent to a substructure of a drilling rig to position said rig structure adjacent to a support apparatus that is movably connected to said substructure, wherein said support apparatus has a raising apparatus comprising a hydraulic cylinder apparatus connected thereto, wherein said support apparatus comprises dual opposed support arms that are each pivotably connected to a respective base, wherein each respective base is connected to a drilling floor supported by said substructure, and wherein positioning said rig structure further comprises positioning each of said dual opposed arms at an angle relative to said respective base so as to facilitate said positioning of said rig structure adjacent to said drilling floor;

moving said support apparatus into a connecting orientation with respect to said rig structure;

connecting said raising apparatus to said rig structure, wherein connecting said raising apparatus to said rig structure comprises releasably interconnecting said dual opposed support arms and said rig structure with said hydraulic cylinder apparatus; and raising said rig structure with said raising apparatus, wherein raising said rig structure comprises contracting said hydraulic cylinder apparatus, said rig structure being substantially maintained in an operating orientation while being raised.

22. A method for installing a rig structure on a drilling rig, the method comprising:

placing a rig structure on a movement apparatus;

moving said movement apparatus on ground adjacent to a substructure of a drilling rig to position said rig structure adjacent to a support apparatus that is movably connected to said substructure, wherein said support apparatus has a raising apparatus comprising a hydraulic cylinder apparatus connected thereto;

moving said support apparatus into a connecting orientation with respect to said rig structure;

connecting said raising apparatus to said rig structure, wherein connecting said raising apparatus to said rig structure comprises interconnecting said hydraulic cylinder apparatus between said support apparatus and said rig structure;

contracting said interconnected hydraulic cylinder apparatus to move said rig structure toward said drilling floor; and raising said rig structure with said raising apparatus, said rig structure being substantially maintained in an operating orientation while being raised.

* * * * *

UNITED STATES PATENT AND TRADEMARK OFFICE

CERTIFICATE OF CORRECTION

PATENT NO. : 8,250,816 B2
APPLICATION NO. : 12/074264
DATED : August 28, 2012
INVENTOR(S) : Robert Benjamin Donnally et al.

It is certified that error appears in the above-identified patent and that said Letters Patent is hereby corrected as shown below:

Col. 12, line 8 (claim 11, line 1), delete “handling”.

Col. 12, line 39 (claim 15, line 1), delete “handling”.

Signed and Sealed this
Twenty-ninth Day of January, 2013

David J. Kappos

David J. Kappos
*Director of the United States Patent and Trademark Office*